US006428138B1

(12) United States Patent
Asauchi et al.

(10) Patent No.: US 6,428,138 B1
(45) Date of Patent: Aug. 6, 2002

(54) PRINTING APPARATUS, METHOD OF PRINTING, AND RECORDING MEDIUM

(75) Inventors: Noboru Asauchi; Koichi Otsuki, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/534,339

(22) Filed: Mar. 24, 2000

(30) Foreign Application Priority Data

Mar. 30, 1999 (JP) ..... 11-087973
May 24, 1999 (JP) ..... 11-143108

(51) Int. Cl.[7] ..... B41J 2/205
(52) U.S. Cl. ..... 347/15; 347/9; 347/10; 347/37
(58) Field of Search ..... 347/9, 10, 12, 347/14, 15, 37

(56) References Cited

U.S. PATENT DOCUMENTS 5,610,637 A 3/1997 Sekiya et al.
6,142,598 A * 11/2000 Iwasaki et al. ..... 347/9
6,154,230 A * 11/2000 Holstun et al. ..... 347/19

FOREIGN PATENT DOCUMENTS

EP 0 895 869 2/1999

OTHER PUBLICATIONS

U.S. application No. 09/445,446, filed Dec. 14, 1999, pending.
U.S. application No. 09/496,407, filed Feb. 2, 2000, pending.
U.S. application No. 09/534,339, filed Mar. 24, 2000, pending.

* cited by examiner

*Primary Examiner*—Craig A. Hallacher
(74) *Attorney, Agent, or Firm*—Oblon, Spivak, McClelland, Maier & Neustadt, P.C.

(57) ABSTRACT

In an ink jet printer with a print head having two nozzle rows arranged at different positions in a main scanning direction, that is, a $0^{th}$ nozzle row and a $1^{st}$ nozzle row, with regard to each color ink, common driving waveforms are used to drive both the $0^{th}$ nozzle row and the $1^{st}$ nozzle row. The driving waveforms are periodically and successively output in a specific cycle where a plurality of driving waveforms are allocated to each pixel. A specific relation between the driving waveforms and a pixel is regulated individually for the respective nozzle rows using two latch signals. For example, in the case of nozzles included in the $0^{th}$ nozzle row, dots are created in a certain pixel with driving signals S1 through S4. In the case of nozzles included in the $1^{st}$ nozzle row, on the other hand, dots are created in a certain pixel with driving signals S3 through S6. Regulating the interval between the two latch signals enables the positions of dots in the main scanning direction formed by the respective nozzle rows to be finely adjusted in the unit of a driving signal. This arrangement effectively prevents a positional misalignment of dots in the main scanning direction.

13 Claims, 23 Drawing Sheets

| INKS | K | C | LC | M | LM | Y |
|---|---|---|---|---|---|---|
| DOT FORMATION TIMINGS | 2 | 1 | 2 | 3 | 2 | 1 |

| | |
|---|---|
| PD=0 | W1=OFF<br>W2=OFF<br>W3=OFF<br>W4=OFF<br>W5=OFF |
| PD=1 | W1=OFF<br>W2=OFF<br>W3=ON<br>W4=OFF<br>W5=OFF |
| PD=2 | W1=OFF<br>W2=ON<br>W3=OFF<br>W4=ON<br>W5=OFF |
| PD=3 | W1=OFF<br>W2=ON<br>W3=ON<br>W4=ON<br>W5=OFF |

PRINTING APPARATUS, METHOD OF PRINTING, AND RECORDING MEDIUM

BACKGROUND OF THE INVENTION

1. Field of the Invention

The present invention relates to a printing apparatus that creates dots to print an image on a printing medium. More specifically the invention pertains to a printing apparatus that enables adjustment of the positions of dot formation in the respective pixels in the main scanning direction.

2. Description of the Related Art

A variety of printers have been used widely to print multi-color, multi-tone images as the output device of the computer and the digital camera. One of such printers is an ink jet printer that causes several color inks to be ejected from a plurality of nozzles formed on a print head, so as to create dots and record an image. In order to attain the high quality printing in this printer, it is desirable to form dots without any significant positional misalignment.

The ink jet printer generally has a print head with a large number of nozzles for the purpose of the improvement in printing speed. FIG. 4 shows one example of the applicable print head. In the example of FIG. 4, a plurality of nozzle arrays, each including a plurality of nozzles Nz arranged at fixed intervals in the sub-scanning direction, are disposed in the main scanning direction. The print head often has a plurality of nozzle rows with regard to each color ink to allow the closely packed arrangement of nozzles. In the example of FIG. 4, each color ink, for example, yellow (Y) ink, has two nozzle rows, that is, a $0^{th}$ nozzle row and a $1^{st}$ nozzle row.

FIG. 27 shows a process of printing with a print head having a plurality of nozzle rows. In the example of FIG. 27, a print head HD having two nozzle rows, that is, a $0^{th}$ nozzle row and a $1^{st}$ nozzle row, is shifted in a predetermined direction to carry out printing. Symbols A and B respectively represent the positions of the print head HD in the main scanning direction at preset timings. Rectangles P1 and P2 respectively denote pixels. An ink droplet Ip is ejected from a nozzle included in the $0^{th}$ nozzle row at the preset timing A, so that one dot is formed in the pixel P1. The print head HD then moves in the predetermined direction. At the preset timing B after elapse of a predetermined time period, a nozzle included in the $1^{st}$ nozzle row reaches the position that has been occupied by the nozzle of the $0^{th}$ nozzle row at the preset timing A. An ink droplet Ip is ejected from the nozzle included in the $1^{st}$ nozzle row at the preset timing B, so that another dot is formed in the pixel P1.

In the printer with the print head HD having the plurality of nozzle rows, the timings of ejecting ink droplets from the respective nozzle rows are varied according to an interval D of the adjoining nozzle rows and a moving speed Vc of the print head HD, so that dots are created in each pixel. Namely dots are formed in each pixel by outputting driving signals, which cause the nozzles Nz to eject ink droplets Ip, at a preset time difference between the respective nozzle rows.

In the prior art printer, however, there may be a positional misalignment of dots in the main scanning direction formed by the plurality of nozzle rows, due to reasons discussed below. The positional misalignment results in the poor picture quality. For example, the interval D between the adjoining nozzle rows may be varied, due to an error in the manufacturing process. In another example, the respective nozzles may have varying ink ejection characteristics, that is, ink ejection speed and direction. In the prior art printer, these variations may cause a positional misalignment of dots in the main scanning direction.

FIG. 28 shows the effects of a positional misalignment of dots in the main scanning direction on the picture quality. The open circles represent the dots formed by the $0^{th}$ nozzle row shown in FIG. 27, whereas the closed circles represent the dots formed by the $1^{st}$ nozzle row. The left column of FIG. 28 shows an ideal alignment of dots to be formed. The right column of FIG. 28, on the other hand, shows a positional misalignment of dots in the main scanning direction formed by the respective nozzle rows. The positional misalignment is recognized as undesirable bents of a straight line and thereby deteriorates the printing quality. With the development of the high-resolution, high-quality printers, the deterioration of the picture quality due to the positional misalignment of dots in the main scanning direction is not negligible.

In order to cancel the positional misalignment of dots in the main scanning direction, one applicable method regulates the dot formation timings with regard to each nozzle row. This method provides separate driving waveform generation circuits and delay circuits with regard to the respective nozzle rows for regulating the output timings of driving waveforms and individually regulates the dot formation timings with regard to the respective nozzle arrays, in order to prevent the positional misalignment of dots in the main scanning direction. Unlike the prior art printer that ejects ink at a fixed timing preset for each nozzle row, this arrangement enables the regulation of the dot formation timings according to the ink ejection characteristics of each nozzle row.

This method, however, requires the additional circuits to regulate the dot formation timings with regard to the respective nozzle rows. In order to attain the richer tone expression, the printer often uses inks of different densities for some colors. This increases the number of different color inks and thereby the number of nozzle rows on the print head. The additional circuits provided for the respective nozzle rows thus cause a significant increase in manufacturing cost of the printer.

The printing method that forms dots both in the forward pass and in the backward pass of the main scan (hereinafter referred to as the bi-directional printing) has been proposed recently to improve the printing speed. In the case of the bi-directional printing, there may be a positional misalignment of dots in the main scanning direction formed in the forward pass and formed in the backward pass, due to the backlash of the mechanism carrying out the main scan or other causes. Namely the bi-directional printing has the same problem as that occurring in the structure having a plurality of nozzle rows in the main scanning direction.

The positional misalignment of dots is the problem commonly arising when there are two or more different conditions with regard to the dot formation timing, for example, a difference in position in the main scanning direction between adjoining nozzle rows and a difference in moving direction of the print head in the course of dot formation. This problem is found not only between a plurality of nozzle rows with regard to one color ink but between nozzle rows of different color inks. The problem is not restricted to the print head having the arrangement of nozzles shown in FIG. 4, but arises in any print head having nozzles disposed at different positions in the main scanning direction. The problem is found not only in the ink jet printer but a variety of other printing apparatuses that create dots to print an image.

SUMMARY OF THE INVENTION

The object of the present invention is thus to provide a technique of preventing a positional misalignment of dots in the main scanning direction and thereby improving the picture quality of the resulting printed image without causing a significant expansion of the circuit structure for driving a print head in a printing apparatus that prints an image with the print head.

At least part of the above and the other related objects is attained by a printing apparatus with a print head having a dot forming element, which creates a dot in response to a driving signal. The printing apparatus carries out main scan, which moves the print head forward and backward relative to a printing medium in a predetermined direction of the printing medium, and creates different dots, which have different dot forming conditions with regard to an ejection timing of ink into each pixel, so as to print an image on the printing medium. The printing apparatus includes: a driving signal output unit that periodically outputs a series of driving signals to the dot forming element in a specific cycle where a plurality of driving signals are allocated to each pixel; an input unit that inputs print data, which represent a density to be expressed in each pixel; a timing storage unit that stores a specific relation between the periodically output driving signals and a pixel with regard to each of the different dot forming conditions; and a head drive unit that carries out the main scan and controls on-off conditions of the plurality of driving signals to create dots in respective pixels according to the input print data, based on the specific relation stored in the timing storage unit.

In the printing apparatus of the present invention, the relation between the driving signals, which are output in a specific cycle where a plurality of driving signals are allocated to each pixel, and the pixel is specified with regard to each of the different dot forming conditions. Namely, the relation determining which part of the successively output driving signals is to be used for formation of dots in each pixel is specified with regard to each of the different dot forming conditions. This arrangement enables the dot forming timing to be regulated in the unit of a time interval when each driving signal is output. The plurality of driving signals are output to each pixel, and the dot formation timing is finely regulated in each pixel according to the number of the output driving signals. The printing apparatus of the present invention thus effectively prevents the positional misalignment of dots in the main scanning direction formed by the different dot forming conditions, thereby improving the picture quality of the resulting printed image. In this printing apparatus, the driving signal is output to the dot forming element at a fixed timing. This accordingly does not require any additional circuit for regulating the dot formation timing with regard to each dot forming condition.

The dot forming conditions represent any conditions that affect the ejection timing of ink to each pixel. The ink ejection timings should be adequately set according to a variety of conditions, in order to ensure formation of dots at predetermined positions in the main scanning direction. For example, the ink ejection timing should be varied with a variation in speed of the main scan of the print head or in speed of ink ejection. In the case where the print head has a plurality of dot forming elements disposed at different positions in the main scanning direction, it is required to vary the ink ejection timing according to the position of the dot forming element in the main scanning direction. In the case of the bi-directional printing, it is also required to change the ink ejection timing between the forward pass and the backward pass of the main scan. These conditions are all included in the different dot forming conditions. Any other conditions that affect the ink ejection timing are also included in the different dot forming conditions.

The printing apparatus of the present invention may be applicable to the variety of dot forming conditions discussed above. In accordance with one preferable application of the printing apparatus, the print head has a plurality of the dot forming elements, each creating a dot in response to the driving signal, arranged in the main scanning direction. The driving signal output unit outputs a common driving signal to the plurality of dot forming elements. The timing storage unit stores the specific relation with regard to each of the plurality of dot forming elements arranged in the main scanning direction.

The following concretely describes the principle of preventing the positional misalignment of dots in the main scanning direction in the printing apparatus of the present invention having the above structure. FIG. 8 shows the principle of adjusting the positions of dot formation in the main scanning direction. Voltage waveforms S1 through S8 shown in the top of FIG. 8 correspond to the successively output driving signals. A print head 28 in the printing apparatus has two rows of dot forming elements having different positions in the main scanning direction, that is, a $0^{th}$ row and a $1^{st}$ row. A signal LAT0 specifies the dot formation timing in each pixel with the dot forming element of the $0^{th}$ row. Another signal LAT1 specifies the dot formation timing in each pixel with the dot forming element of the $1^{st}$ row. The bottom of FIG. 8 shows pixels and dots formed therein. Each rectangle defined by the broken line represents a pixel, and each hatched circle represents a dot.

In the example of FIG. 8, with regard to the $0^{th}$ row, dots are formed in the left pixel with the driving signals S1 through S4 and in the right pixel with the driving signals S5 through S8. With regard to the $1^{st}$ row, on the other hand, dots are formed in the left pixel with the driving signals S3 through S6 and in the right pixel with the driving signals of and after S7. The middle portion of FIG. 8 shows the movement of the print head 28 in four stages from a preset timing 'a' to another preset timing 'd'. When the print head 28 is located at the position of the timing 'a', dot formation with the dot forming element of the $0^{th}$ row starts in response to the driving signal S1. When the print head 28 moves to the position of the timing 'b', dot formation with the dot forming element of the $1^{st}$ row starts in response to the driving signal S3. This position is substantially identical with the position of the dot forming element of the $0^{th}$ row at the timing 'a'. The dots formed by the dot forming elements of the $1^{st}$ row are thus practically aligned in the main scanning direction with the dots formed by the dot forming elements of the $0^{th}$ row.

In this example, the driving signals S1 through S4 are allocated to each pixel with regard to the $0^{th}$ row, whereas the driving signals S3 through S7 are allocated to each pixel with regard to the $1^{st}$ row. Regulating the relationship between the driving waveforms and the pixel enables the relative positions of dots in the main scanning direction formed by the dot forming element of the $0^{th}$ row and formed by the dot forming element of the $1^{st}$ row to be adjusted finely. The relationship between the driving waveforms and the pixel is regulated by taking into account the interval in the main scanning direction between the dot forming element of the $0^{th}$ row and the dot forming element of the $1^{st}$ row, the moving speed of the print head 28, and the positional misalignment of dots formed by the respective dot forming elements. In the example of FIG. 8, the driving signals are output in the cycle where four driving signals are allocated to each pixel. The position of dot formation is thus adjusted in the unit of one-quarter of the width of each pixel.

The 'pixel' is defined as follows in the specification hereof. In the example of FIG. 8, at most four dots can be formed in each pixel. The term 'pixel' generally has a plurality of meanings. In one case, every position where one dot may be formed is defined as a pixel. In this definition, each rectangle in FIG. 8 corresponds to four pixels. In another case, the pixel is defined based on the print data. The on-off conditions of four dots, which may be formed in each rectangle shown in FIG. 8, are determined unequivocally according to the print data of the rectangle. The term 'pixel' in this specification is defined in the latter meaning. Namely the unit of controlling the on-off conditions of the dots is referred to as the pixel. In the definition of this specification, a plurality of dots may be formed in each pixel. In the actual printing operation, the unit of the print data is referred to as the pixel.

The above example regards the case in which four driving signals are allocated to each pixel. The principle of the present invention is, however, applicable to any structure of the printing apparatus that outputs driving signals in a specific cycle where a plurality of driving signals are allocated to each pixel. The greater number of the driving signals allocated to each pixel enhance the accuracy of the adjustment of the positions of dot formation.

The principle of the present invention is applicable to the printing apparatus that enables expression of multilevel tones in each pixel. In the case where a plurality of driving signals are allocated to each pixel as shown in FIG. 8, multilevel densities, for example, 'formation of no dot', 'formation of one dot', 'formation of two dots', 'formation of three dots', and 'formation of four dots', can be expressed with regard to each pixel by controlling the on-off conditions of the dots corresponding to these driving signals. In this case, the timing storage unit stores the relations to enable the multilevel tone expression. The application of the technique of the present invention to the printing apparatus that enables the multilevel expression ensures the smooth tone expression and attains the high quality printing.

The technique of the present invention is, however, not restricted to the printing apparatus that enables multilevel expression. In the example of FIG. 8, the printing apparatus may print an image in only two tone levels, that is, 'formation of no dot' and 'formation of four dots'. In this case, the timing storage unit stores the relations to enable expression of two tone levels. The timing storage unit of the present invention is thus applicable to both the printing apparatus of the two level expression and the printing apparatus of the multilevel expression.

In accordance with another preferable application of the printing apparatus, the timing storage unit stores the specific relation with regard to each of a forward pass and a backward pass of the main scan, and the head drive unit drives the print head in both the forward pass and the backward pass of the main scan.

In the case of driving the print head both in the forward pass and in the backward pass of the main scan (hereinafter referred to as the bi-directional printing), the printing apparatus of the above application enables the adjustment of the positions of dot formation. The bi-directional printing advantageously improves the printing speed, but may have a positional misalignment of dots in the main scanning direction, for example, due to the backlash of the head-driving mechanism, which results in the poor picture quality. The printing apparatus of the above arrangement can store the relations between the driving signals and the pixel corresponding to the moving directions of the print head to create dots.

In the case where there are two dot forming elements respectively included in the $0^{th}$ row and the $1^{st}$ row, the relation with regard to the forward pass and the relation with regard to the backward pass are stored for each of the dot forming elements. This arrangement effectively prevents the positional misalignment of dots formed by the dot forming element of the $0^{th}$ row and formed by the dot forming element of the $1^{st}$ row in each of the forward pass and the backward pass of the main scan. The arrangement also prevents the positional misalignment of dots formed in the forward pass and formed in the backward pass of the main scan. The same effects are exerted in the structure having a greater number of dot forming elements. In another structure having only a single row of the dot forming element, this arrangement also effectively prevents the positional misalignment of dots formed in the forward pass and formed in the backward pass of the main scan. The printing apparatus of the above application thus significantly improves the picture quality in the case of the bi-directional printing.

In the printing apparatus that carries out the bi-directional printing, it is preferable that the head drive unit changes the on-off conditions of the driving signals in the backward pass of the main scan from those in the forward pass.

In the case of the bi-directional printing, the relation between the driving waveforms and the pixel in the backward pass of the main scan is reverse to that in the forward pass. Setting the different on-off conditions of the driving signals in the forward pass and in the backward pass of the main scan enables dots recorded in the forward pass and the backward pass to have a consistent configuration, thereby improving the picture quality of the resulting printed image.

This function is described in detail with FIG. 23. In the example of FIG. 23, four driving waveforms are allocated to each pixel, and three out of the four driving waveforms are used for dot formation. The left portion of FIG. 23 shows the dot formation patterns in the forward pass of the main scan, whereas the right portion of FIG. 23 shows the dot formation patterns in the backward pass. The dot of the highest density, that is, the dot corresponding to the print data PD=3, is created with the driving waveforms W1 through W3 in the forward pass of the main scan and with the driving waveforms W2 through W4 in the backward pass. Changing the dot formation patterns in the backward pass from those in the forward pass enables the dots of an identical configuration to be formed at appropriate positions in the respective pixels both in the forward pass and in the backward pass of the main scan. In the example of FIG. 23, part of the driving waveforms allocated to each pixel are used for dot formation. The same function is attained in the structure where all the driving waveforms allocated to each pixel are used for dot formation.

Irrespective of the execution or non-execution of the bi-directional printing, the head drive unit may attain a first state, in which all the plurality of driving signals allocated to each pixel are on, in the process of dot formation in each pixel.

The head drive unit may also attain a second state, in which at least part of the plurality of driving signals allocated to each pixel is always off, in the process of dot formation in each pixel.

The former arrangement enables the tone expression in a wide range to a specific density expressible by setting on all the driving signals allocated to each pixel. This is not restricted to the structure where all the possible combinations of the on-off conditions of the driving signals are stored.

The latter arrangement corresponds to the structure in which the greater number of driving signals than the number of driving signals corresponding to the densities to be expressed are allocated to each pixel. For example, when n driving signals are required to express preset densities in the respective pixels, (n+1) or a greater number of driving signals are allocated to each pixel. In an allowable range of the output frequency of the driving signals, the greater number of driving signals than required are allocated to each pixel. This arrangement enables the finer adjustment of the positions of dot formation.

In the printing apparatus of the present invention, it is preferable that the plurality of driving signals are of an identical type.

This enables the dot formation timing of each dot forming element to be easily regulated.

In accordance with another preferable application of the printing apparatus of the present invention, the driving signal output unit outputs different types of the driving signals allocated to each pixel, and the head drive unit changes the on-off conditions of the driving signals according to the specific relation stored in the timing storage unit.

When the different types of driving signals are periodically output to execute printing, the densities expressed in the respective pixels may be varied according to the relation between the driving signals and the pixel. This phenomenon is described in detail with FIG. 25. Like the example of FIG. 8, in the example of FIG. 25, three different types of driving signals are periodically output in a specific cycle where four driving signals are allocated to each pixel. The three different types of driving signals include a driving signal S1 for creating a smallest-diametral (small-size) dot, driving signals S2 and S3 for creating an intermediate-diametral (medium-size) dot, and a driving signal S4 for creating a largest-diametral (large-size) dot.

The driving signals S1 through S4 are output to the dot forming elements included in the $0^{th}$ row to create dots, whereas the driving signals S3 through S6 are output to the dot forming elements included in the $1^{st}$ row to create dots. In the case of the dot forming element of the $0^{th}$ row, the first driving signal S1 out of all the allocated driving signals is used to create a small dot in a certain pixel. In the case of the dot forming element of the $1^{st}$ row, on the other hand, the third driving signal S5 out of all the allocated driving signals is used to create a small dot in a certain pixel.

In the printing apparatus of the above arrangement, the on-off conditions of the driving signals are changed according to the relation between the driving signals and the pixel, that is, corresponding to each of the dot forming elements having different positions in the main scanning direction. In the example of FIG. 25, in the case of the dot forming elements of the $0^{th}$ row, dots are created according to the print data with the driving signals S1 through S4. In the case of the dot forming elements of the $1^{st}$ row, on the other hand, dots are created according to the print data with the driving signals S3 through S6. Changing the dot formation patterns corresponding to the respective dot forming elements enables the fine adjustment of the positions of dot formation without deteriorating the tone expression even when the plurality of driving signals are of different types. In the above example, four driving signals including three different types are allocated to each pixel. This is, however, only illustrative, and the above arrangement is applicable to any structure in which an arbitrary number of driving signals including an arbitrary number of different types are allocated to each pixel. The above expression 'according to the relation', does not mean that all the possible relations have different on-off conditions of the driving signals.

The principle of the present invention is applicable to a variety of printing apparatuses that create dots.

In one preferable application, the dot forming element ejects ink to create a dot.

The dot forming elements, which eject ink to create dots, often have a positional misalignment of dots in the main scanning direction, due to the ink ejection characteristics. The application of the present invention effectively prevents the positional misalignment of dots and thus remarkably improves the picture quality of the resulting printed image.

A variety of techniques may be applicable to the dot forming element that ejects ink. For example, the dot forming element may eject ink with a pressure of bubbles occurring in ink under a supply of electricity to a heater located in the ink.

It is, however, especially preferable that the dot forming element ejects ink in response to a deflection occurring on application of a voltage, as the driving signal, to a piezoelectric element, so as to create a dot.

The printing apparatus of the present invention periodically outputs the driving signals in a specific cycle where a plurality of driving signals are allocated to each pixel. The dot forming element is accordingly driven at a relatively high frequency. The dot forming element that ejects ink using a piezoelectric element advantageously has a high driving frequency. The application of the principle of the present invention is thus especially effective in the printing apparatus having the dot forming elements utilizing the piezoelectric elements for ink ejection. The application of the present invention to such a printing apparatus effectively prevents the positional misalignment of dots without lowering the printing speed.

In the present invention, the specific relation stored in the timing storage unit may be set in advance for each printing apparatus.

In one preferable application of the present invention, the printing apparatus further includes: a test pattern printing unit that prints a test pattern, which is used to detect a relative positional misalignment of dots, which are created by the print head, in the main scanning direction; and a timing setting unit that sets the specific relation stored in the timing storage unit, based on the printed test pattern.

The printing apparatus of the above application detects the positional misalignment of dots in the main scanning direction using the printed test pattern, and sets the specific relation between the driving signals and the pixel, based on the result of the detection. The positional misalignment of dots in the main scanning direction is ascribed not only to some errors in the manufacturing process but also to the time-based change of the mechanism and ink or other causes occurring in operation of the printing apparatus. The printing apparatus of the above arrangement corrects the specific relation between the driving signals and the pixel using the test pattern, so as to minimize the positional misalignment of dots occurring in operation of the printing apparatus. This arrangement enables the printing quality to be readily kept at a high level and significantly improves the convenience of the printing apparatus.

The present invention is also directed to a method of carrying out main scan that moves a print head with a dot forming element, which creates a dot in response to a driving signal, forward and backward relative to a printing medium in a predetermined direction of the printing medium, and creating different dots, which have different dot forming conditions with regard to an ejection timing of ink into each pixel, so as to print an image on the printing medium. The method includes the steps of: (a) inputting print data that represent a density to be expressed in each pixel; (b) outputting a timing signal that specifies a relation between a series of driving signals, which are periodically output in a specific cycle where a plurality of driving signals are allocated to each pixel, and a pixel with regard to each of the different dot forming conditions; and (c) carrying out the main scan and controlling on-off conditions of the plurality of driving signals to create dots in respective pixels according to the input print data, in response to the timing signal.

Like the printing apparatus discussed above, the method of the present invention effectively prevents the positional misalignment of dots in the main scanning direction, so as to attain the high quality printing. The variety of modifications and additions explained with regard to the printing apparatus are also applicable to the method of the present invention.

The present invention is further directed to a computer readable recording medium, in which a specific program is recorded in a computer readable manner. The specific program is used to drive a printing apparatus with a print head having a dot forming element, which creates a dot in response to a driving signal. The printing apparatus carries out main scan, which moves the print head forward and backward relative to a printing medium in a predetermined direction of the printing medium, and creates different dots, which have different dot forming conditions with regard to an ejection timing of ink into each pixel, so as to print an image on the printing medium. The specific program includes a program code that causes a computer to specify a relation between a series of driving signals, which are periodically output in a specific cycle where a plurality of driving signals are allocated to each pixel, and a pixel with regard to each of the different dot forming conditions.

The computer executes the specific program recorded in the recording medium, so as to specify the relation for each of the dot forming elements, in order to compensate for the positional misalignment of dots. The relation may be specified at every execution of printing or may alternatively follow data previously stored. The specific program having this function is used to drive the printing apparatus, so as to attain the high quality printing. The specific program may be an independent program to actualize the above function or may alternatively be part of the programs for driving the printing apparatus.

Typical examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Another possible application of the present invention is a program supply apparatus that supplies a program attaining the above function to the computer via a communication path. The present invention may also be directed to a program attaining the above function or a variety of signals that are equivalent to such a program.

These and other objects, features, aspects, and advantages of the present invention will become more apparent from the following detailed description of the preferred embodiments with the accompanying drawings.

DESCRIPTION OF THE PREFERRED EMBODIMENTS

(1) Structure of Apparatus

Figure 1:
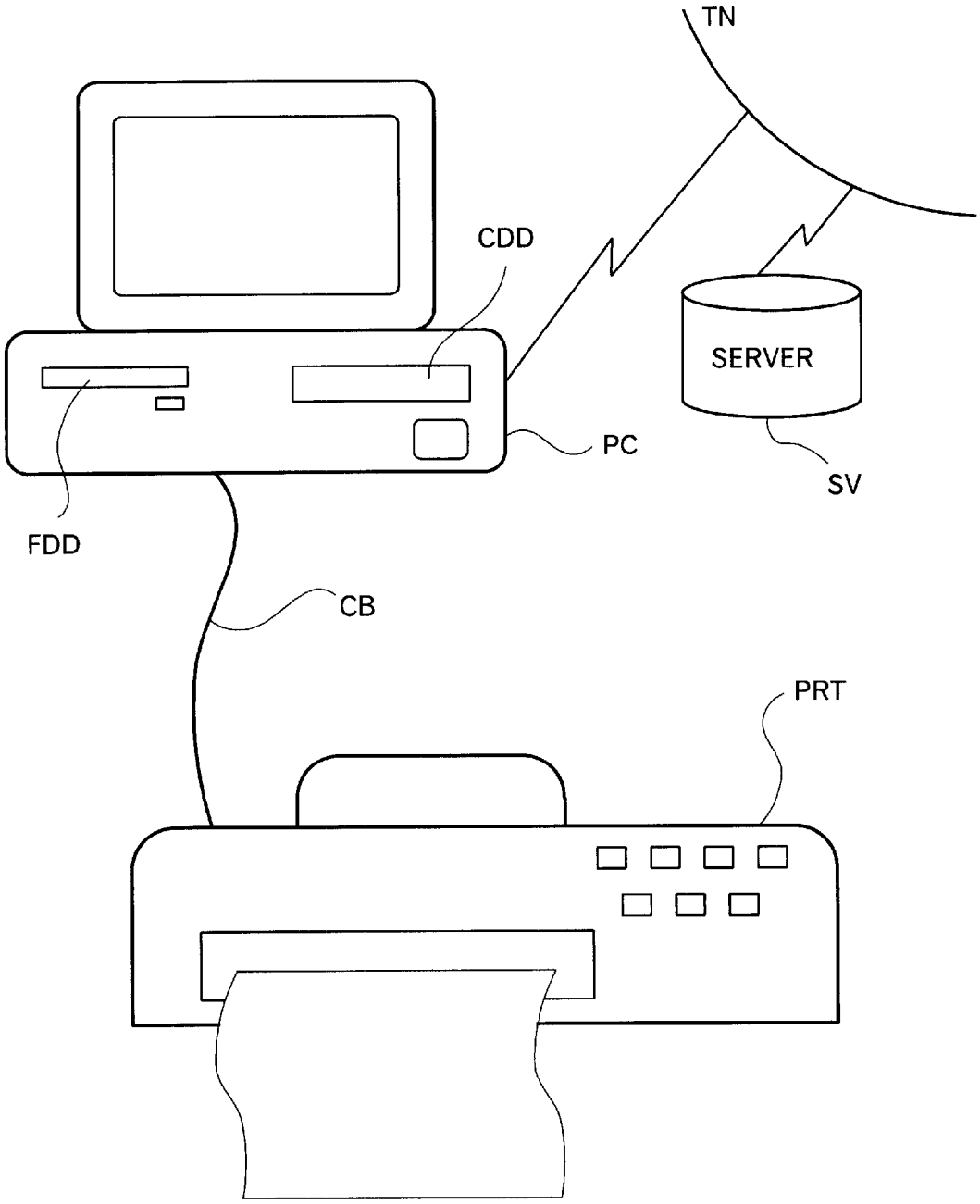
FIG. 1 schematically illustrates the structure of a printing apparatus in one embodiment of the present invention.

FIG. 1 schematically illustrates the structure of a printing apparatus in one embodiment of the present invention. The printing apparatus of the embodiment includes a printer PRT that is connected to a computer PC via a cable CB. The computer PC transfers print data to the printer PRT and controls the operation of the printer PRT. These processes are executed according to a specific program called a printer driver.

The computer PC reads the specific program from a recording medium like a flexible disk set in a flexible disk drive FDD or a CD-ROM set in a CD-ROM drive CDD, and executes the program. The computer PC is connected to an external network TN and may gain access to a specific server SV to download a required program. The whole program required for printing may be loaded at once, or only some modules included in the program may be loaded separately.

Figure 2:
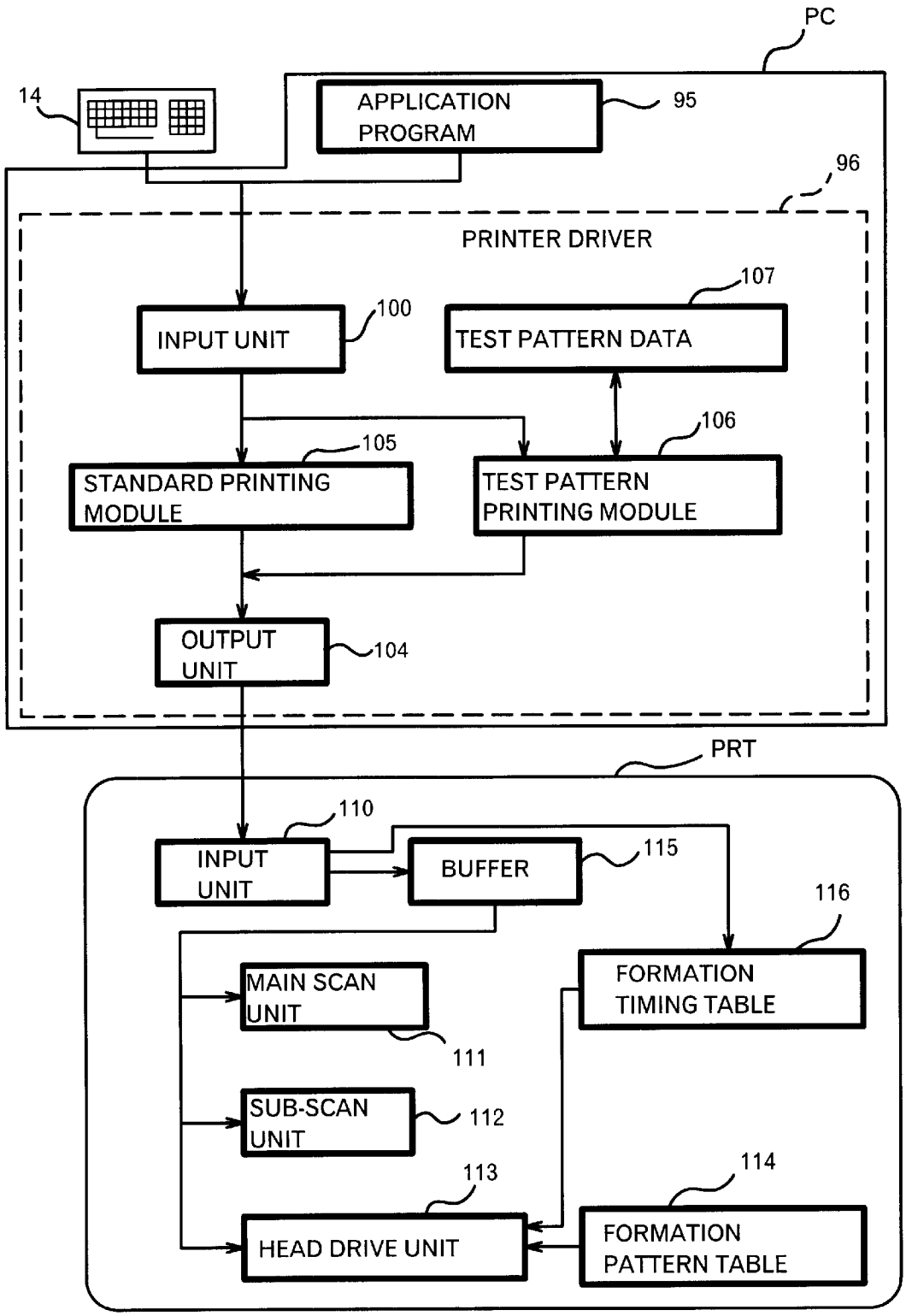
FIG. 2 is a functional block diagram illustrating functions of the printing apparatus of the embodiment.

FIG. 2 is a functional block diagram illustrating functions of the printing apparatus of the embodiment. In the computer PC, an application program 95 works under a predetermined operating system. A printer driver 96 is incorporated in the operating system. The application program 95 carries out a variety of processes, for example, generation of an image to be printed by the printer PRT.

The printer driver 96 receives a command input through an operation of a keyboard 14 or a printing instruction output from the application program 95 via an input unit 100. The printer driver 96 executes a variety of processes in response to the respective inputs. In response to the printing instruction output from the application program 95, the input unit 100 of the printer driver 96 receives image data from the application program 95, and a standard printing module 105 converts the image data into signals processible by the printer PRT. The standard printing module 105 performs color correction that converts color components of the input image data into color components expressible with inks in the printer PRT, halftone processing that enables the tone values of the image data to be expressed in the form of dot recording densities, and rasterization that reorders the processed data in a sequence of actual transfer to the printer PRT. The resulting processed and reordered data are transferred as print data from an output unit 104 to the printer PRT.

One of the processes executed by the printer driver 96 in response to a command input from the keyboard 14 regulates the dot formation timing in the printer PRT. In response to the command to regulate the dot formation timing, the printer driver 96 causes a test pattern printing module 106 to print a test pattern according to test pattern data 107 stored in advance. The data for printing the test pattern are output from the output unit 104 to the printer PRT.

In the printer PRT, an input unit 110 receives the image data and the data for printing the test pattern transferred from the printer driver 96 and temporarily stores the input data into a buffer 115. A main scan unit 111 and a sub-scan unit 112 carry out the main scan of the print head and the feed of printing paper according to the data stored in the buffer 115, while a head drive unit 113 drives the print head to print an image.

As described later, the printer PRT has a plurality of nozzle arrays disposed at different positions in the main scanning direction. The dot formation timing of each nozzle array is regulated to ensure adequate dot formation in the respective pixels. The dot formation timings are stored in a formation timing table 116. The printer PRT may form a plurality of dots in each pixel and expresses the multilevel densities of the respective pixels by changing the number of dots created in each pixel, that is, by changing the dot formation pattern. The relationship between the print data supplied to the printer PRT and the dot formation pattern is stored in a formation pattern table 114. The head drive unit 113 refers to both the formation timing table 116 and the formation pattern table 114 and drives the print head to create dots. The formation pattern table 114 may store the relationship between the print data and the dot formation pattern in the form of software or alternatively in the form of hardware. One applicable structure is a circuit that outputs a signal representing a predetermined dot formation pattern corresponding to the input print data.

The adjustment of the dot formation timing is executed in the following manner. The user specifies an optimum printing timing through the operation of the keyboard 1, based on the printing result of the test pattern. The input unit 100 of the printer driver 96 receives the specified printing timing as a piece of information, which is eventually output to the printer PRT via the output unit 104. The input unit 110 of the printer PRT receives the piece of information and rewrites the contents of the formation timing table 116 based on the input, so as to change the dot formation timing. These functional groups enable the printing apparatus of the embodiment to print an image while adjusting the dot formation timing.

Figure 3:
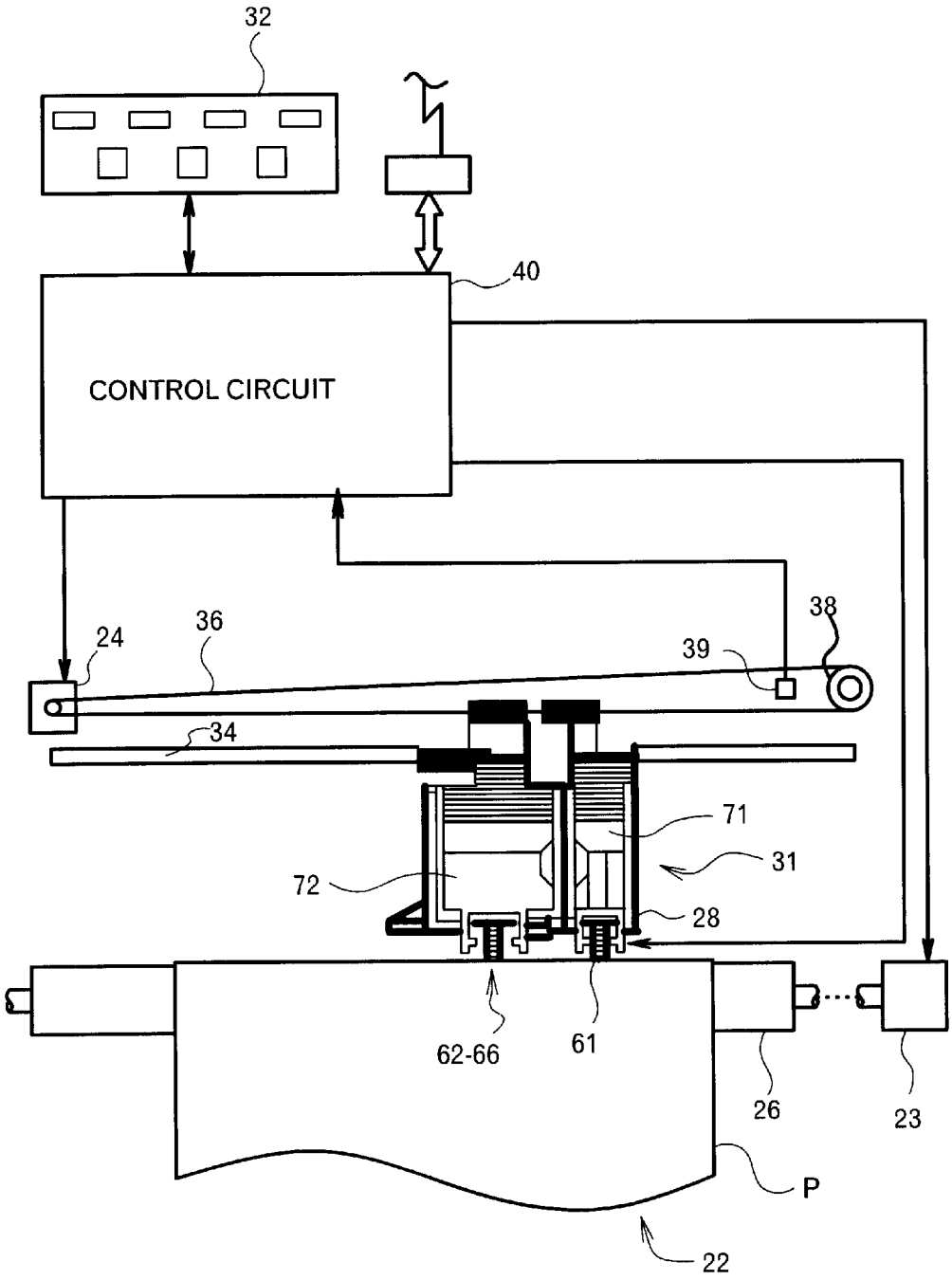
FIG. 3 schematically illustrates the structure of a printer PRT included in the printing apparatus of the embodiment.

FIG. 3 schematically illustrates the structure of the printer PRT. The printer PRT has a circuit that feeds a sheet of printing paper P by means of a sheet feed motor 23, a circuit that moves a carriage 31 forward and backward along the axis of a platen 26 by means of a carriage motor 24, a circuit that drives a print head 28 mounted on the carriage 31 to carry out ejection of ink and formation of dots, and a control circuit 40 that controls transmission of signals to and from the sheet feed motor 23, the carriage motor 24, the print head 28, and a control panel 32.

The circuit of reciprocating the carriage 31 along the axis of the platen 26 includes a sliding shaft 34 that is arranged in parallel with the axis of the platen 26 to slidably support the carriage 31, a pulley 38, an endless drive belt 36 that is spanned between the carriage motor 24 and the pulley 38, and a position sensor 39 that detects the position of the origin of the carriage 31.

A black ink cartridge 71 for black ink (K) and a color ink cartridge 72 in which five color inks, that is, cyan (C), light cyan (LC), magenta (M), light magenta (LM), and yellow (Y), are accommodated are detachably attached to the carriage 31 in the printer PRT. A total of six ink ejection heads 61 through 66 are formed on the print head 28 that is disposed in the lower portion of the carriage 31.

Figure 4:
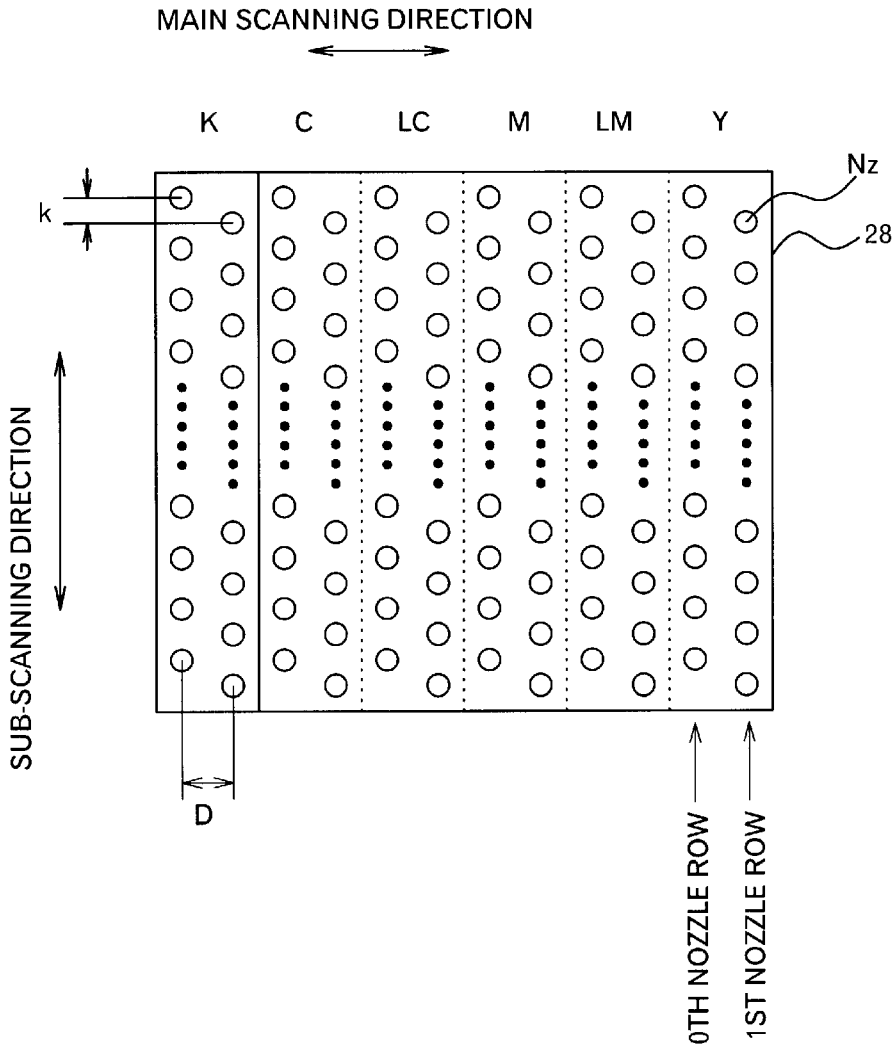
FIG. 4 shows an arrangement of nozzles Nz in each of ink ejection heads 61 through 66 formed on a print head 28 in the printer PRT.

FIG. 4 shows an arrangement of nozzles Nz in each of the ink ejection heads 61 through 66. The arrangement of nozzles shown in FIG. 4 has six nozzle arrays, wherein each nozzle array ejects ink of each color and includes forty-eight nozzles Nz that are arranged in zigzag at a fixed nozzle pitch k. Each nozzle array consists of two rows of nozzles that are arranged at an interval D in the main scanning direction. One of the two rows of nozzles is hereinafter referred to as the $0^{th}$ nozzle row and the other is referred to as the $1^{st}$ nozzle row.

Figure 5:
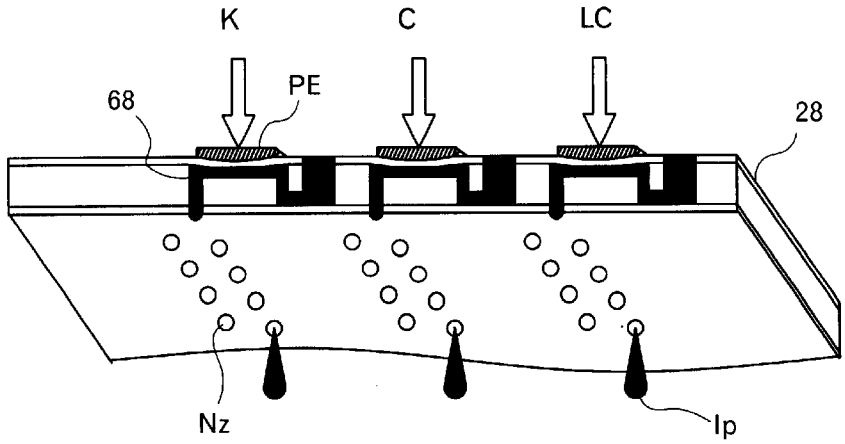
FIG. 5 shows the principle of ejecting ink from the print head 28 in the printer PRT.

FIG. 5 shows the principle of ejecting ink from the print head 28. For convenience of illustration, FIG. 5 shows the internal structure of only the ink ejection heads for the color inks K, C, and LC. Each nozzle has an ink conduit 68, through which a supply of ink is fed from either one of the ink cartridges 71 and 72. A piezoelectric element PE is disposed adjacent to the ink conduit 68. When the control circuit 40 applies a predetermined driving voltage to the piezoelectric element PE, the deflection of the piezoelectric element PE deforms the ink conduit 68 in the direction of the arrow, so as to cause ejection of an ink droplet Ip.

Figure 6:
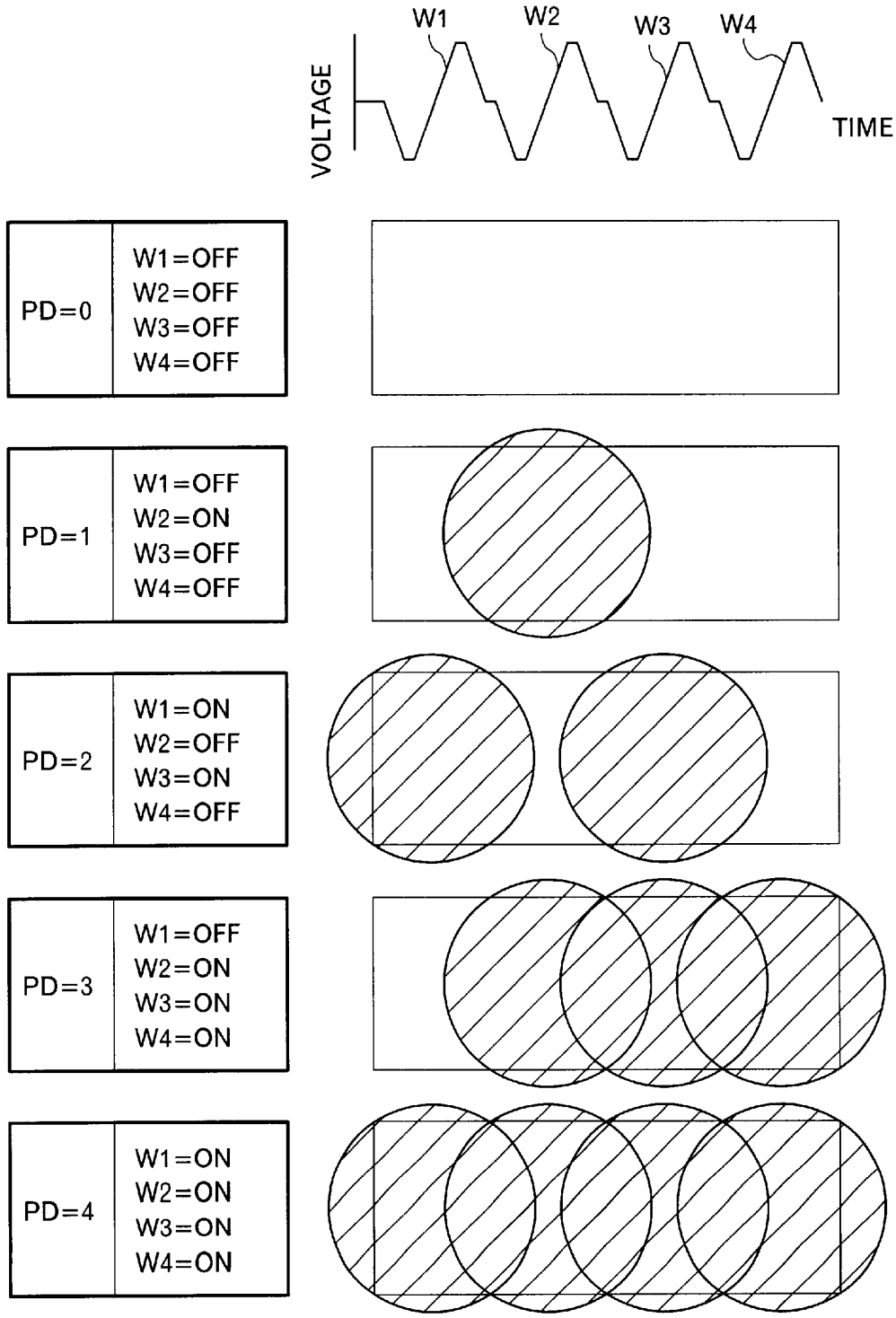
FIG. 6 shows mapping of print data PD to dot formation patterns in the embodiment.

The printer PRT ensures expression of five-level densities in each pixel by changing the number of dots formed in each pixel. The print data represent the densities to be expressed in the respective pixels and take integral values in the range of 0 to 4. FIG. 6 shows mapping of the print data PD to the dot formation patterns in the embodiment. Each rectangle represents a pixel, and each hatched circle represents a dot. As shown in FIG. 6, when the print data PD is equal to 0, all driving waveforms W1 through W4 are set off, so that no dot is created. When the print data PD is equal to 1, only the driving waveform W2 is set on, so that only one dot is created. When the print data PD is equal to 2, the driving waveforms W1 and W3 are set on, so that two dots are created. When the print data PD is equal to 3, only the driving waveform W1 is set off, so that three dots are created. When the print data PD is equal to 4, all the driving waveforms W1 through W4 are set on, so that four dots are created.

The main scan, the sub-scan, and the formation of dots are controlled by the control circuit 40. The control circuit 40 is constructed as a microcomputer including a CPU, a PROM, and a RAM. The control circuit 40 also has an oscillator that periodically outputs driving voltages to drive the print head 28, and a driving circuit that drives the respective nozzles Nz to create dots in the respective pixels.

Figure 7:
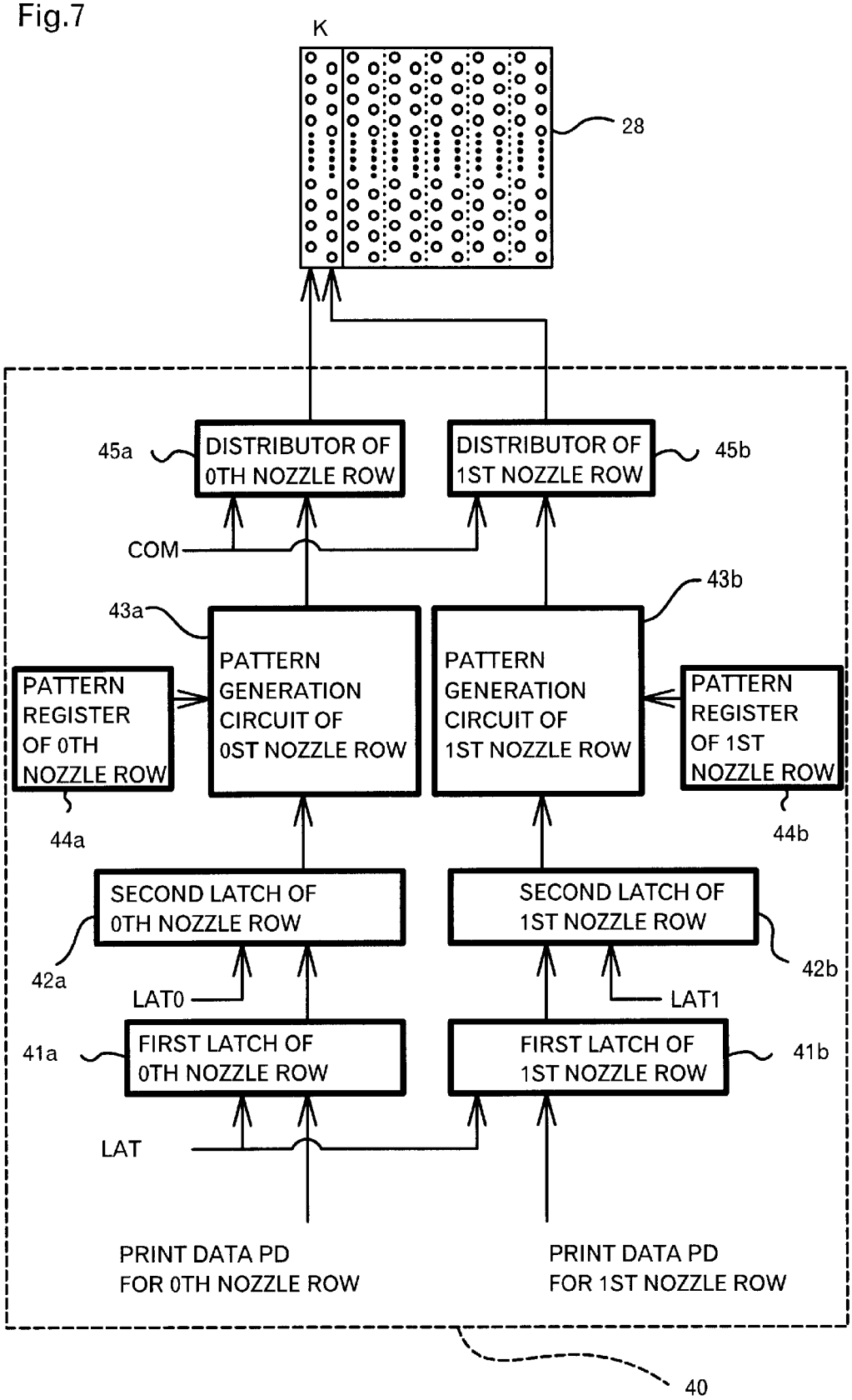
FIG. 7 is a circuit diagram of the structure that drives the respective nozzles.

The following describes the mechanism of regulating the dot formation timing with regard to each nozzle and creating dots. FIG. 7 is a circuit diagram of the structure that drives the respective nozzles. More specifically FIG. 7 shows the structure of the driving circuit that is included in the control circuit 40 and involved in driving the respective nozzles.

The control circuit 40 has two sets of circuits corresponding to the $0^{th}$ nozzle row and the $1^{st}$ nozzle row, respectively. The print data PD are distributed to the $0^{th}$ nozzle row and the $1^{st}$ nozzle row and are input into the respective circuits in synchronism with a latch signal LAT that controls the data input. The print data PD with regard to the $0^{th}$ nozzle row are stored in a first latch 41*a* of the $0^{th}$ nozzle row. The print data PD with regard to the $1^{st}$ nozzle row are stored in a first latch 41*b* of the $1^{st}$ nozzle row.

The data stored in the first latch 41*a* of the $0^{th}$ nozzle row are subsequently transferred to a second latch 42*a* of the $0^{th}$ nozzle row. The transfer is executed in synchronism with a latch signal LAT0 that controls the timing of data output to the $0^{th}$ nozzle row. The data stored in the first latch 41*b* of the $1^{st}$ nozzle row are, on the other hand, transferred to a second latch 42*b* of the $1^{st}$ nozzle row. The transfer is executed in synchronism with a latch signal LAT1 that controls the timing of data output to the $1^{st}$ nozzle row. The latch signals LAT0 and LAT1 are output at intrinsic timings regulated to enable dots to be created at appropriate positions by the respective nozzle rows. These latch signals LAT, LAT0, and LAT1 are output at preset timings under the control of the CPU. The output timings of these latch signals LAT, LAT0, and LAT1 are stored in advance in the form of a formation timing table in the PROM of the control circuit 40.

The print data PD output from the second latch 42*a* of the $0^{th}$ nozzle row are converted into signals, which specify the on-off conditions of the series of driving waveforms, by a pattern generation circuit 43*a* of the $0^{th}$ nozzle row. As described previously with FIG. 6, the print data PD represent densities to be expressed in the respective pixels and take the integral values in the range of 0 to 4. When the print data PD is equal to 0, the pattern generation circuit 43*a* of the $0^{th}$ nozzle row generates a 4-bit signal that specifies the off condition of all the driving waveforms W1 through W4. When the print data PD is equal to 1, 2, 3, and 4, the pattern generation circuit 43*a* of the $0^{th}$ nozzle row generates 4-bit signals that respectively specify the on-off conditions of the driving waveforms W1 through W4, in order to create dots according to the dot formation patterns shown in FIG. 6. The relationship between the values of the print data PD and the 4-bit signals specifying the on-off conditions of the driving waveforms W1 through W4 is stored in a pattern register 44*a* of the $0^{th}$ nozzle row. The pattern generation circuit 43*a* of the $0^{th}$ nozzle row refers to the pattern register 44*a* of the $0^{th}$ nozzle row, so as to generate the 4-bit signals specifying the on-off conditions of the respective driving waveforms W1 through W4.

In a similar manner, the print data PD output from the second latch 42*b* of the $1^{st}$ nozzle row are converted into signals, which specify the on-off conditions of the series of the driving waveforms, by a pattern generation circuit 43*b* of the $1^{st}$ nozzle row. The relationship between the values of the print data PD and the 4-bit signals specifying the on-off conditions of the driving waveforms W1 through W4 is stored in a pattern register 44*b* of the $1^{st}$ nozzle row. The pattern generation circuit 43*b* of the $1^{st}$ nozzle row refers to the pattern register 44*b* of the $1^{st}$ nozzle row, so as to generate the 4-bit signals specifying the on-off conditions of the respective driving waveforms W1 through W4. In this embodiment, the driving waveforms W1 through W4 are identical with one another. The pattern register 44*a* of the $0^{th}$ nozzle row and the pattern register 44*b* of the $1^{st}$ nozzle row may thus be constructed as a common circuit. In this embodiment, however, the pattern registers 44*a* and 44*b* are provided as separate circuits, in order to carry out the processing of the $0^{th}$ nozzle row in parallel to the processing of the $1^{st}$ nozzle row, thereby attaining the high-speed processing.

The 4-bit signals generated by the pattern generation circuit 43*a* of the $0^{th}$ nozzle row are output to a distributor 45*a* of the $0^{th}$ nozzle row. The distributor 45*a* of the $0^{th}$ nozzle row receives a driving waveform COM, which is generated by an oscillator (not shown) and output successively. The distributor 45*a* of the $0^{th}$ nozzle row sets the on-off conditions of the respective driving waveforms W1 through W4, based on the 4-bit signals input from the pattern generation circuit 43*a* of the $0^{th}$ nozzle row, and outputs the preset on-off conditions of the driving waveforms W1 through W4 to the respective nozzles. The 4-bit signals generated by the pattern generation circuit 43*b* of the $1^{st}$ nozzle, on the other hand, are output to a distributor 45*b* of the $1^{st}$ nozzle row. The distributor 45*b* of the $1^{st}$ nozzle row also receives the driving waveform COM, which is identical with the driving waveform COM input into the distributor 45*a* of the $0^{th}$ nozzle row. The distributor 45*b* of the $1^{st}$ nozzle row sets the on-off conditions of the respective driving waveforms W1 through W4, based on the 4-bit signals input from the pattern generation circuit 43*b* of the $1^{st}$ nozzle row, and outputs the preset on-off conditions of the driving waveforms W1 through W4 to the respective nozzles.

The description regards the nozzle array of the black (K) ink among the plurality of nozzle arrays of the respective color inks formed on the print head 28. Similar circuit structures are provided independently for the other five color inks. The printer PRT utilizes, as the driving signal COM, a signal output from an individual oscillator provided for each color ink. This arrangement ensures the adjustment of the driving waveform with regard to each color ink and thereby minimizes the difference among the quantities of the respective inks, due to the difference among the characteristics of the inks. Another possible arrangement may supply an identical driving signal, which has been output from a single oscillator, to the nozzle arrays of the respective color inks at different timings that are shifted by a preset time interval by a delay circuit (not shown). Still another possible arrangement outputs an identical driving waveform to the nozzle arrays of all the color inks at an identical timing and regulates the dot formation timings of the respective nozzle arrays of the different color inks with the latch signals LAT0 and LAT1.

Figure 8:
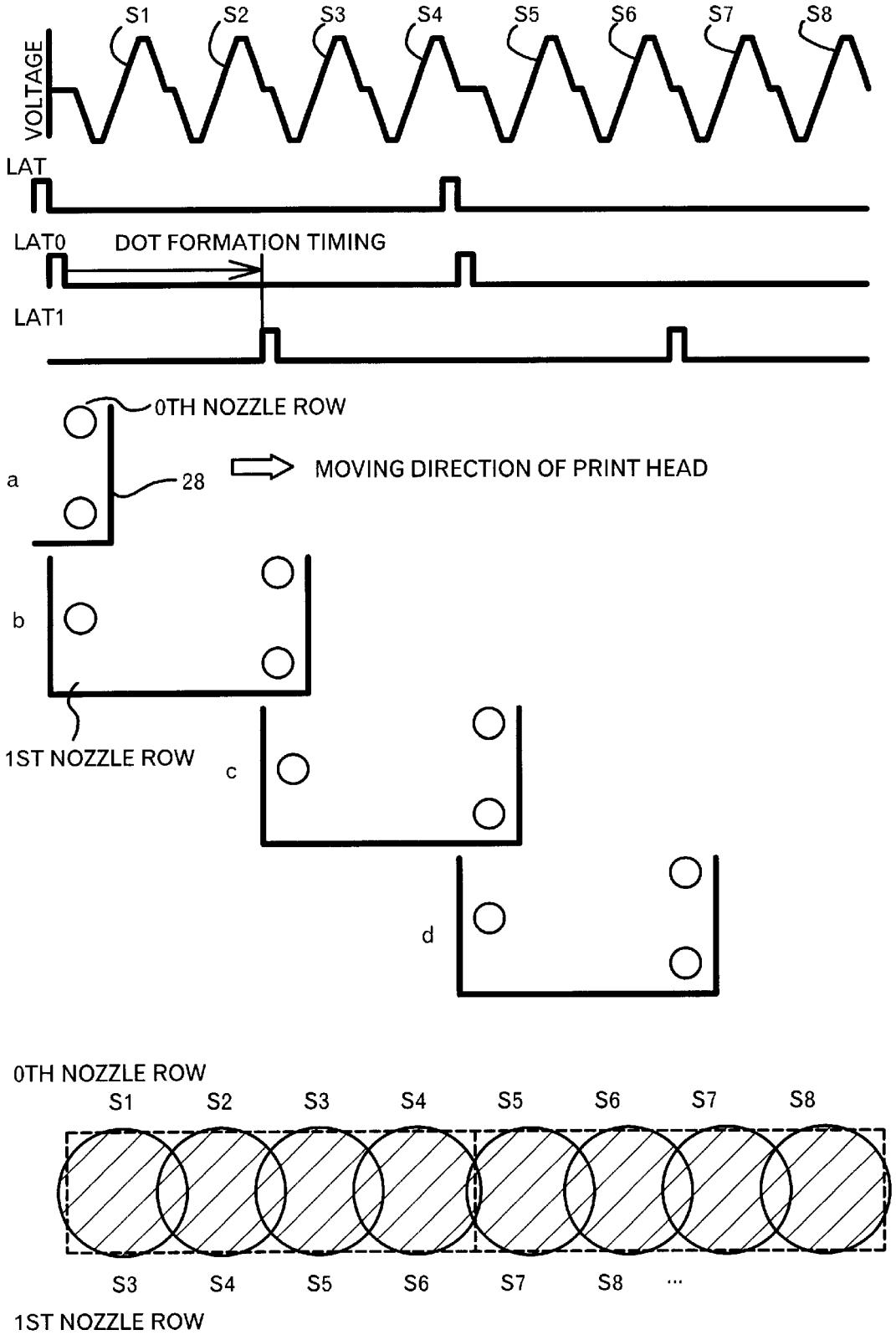
FIG. 8 shows the principle of adjusting the positions of dot formation in the main scanning direction.

FIG. 8 shows the state of dot formation by the driving circuit structure described above. The upper portion of FIG. 8 shows voltage pulses S1 through S8 corresponding to the driving waveforms or the driving signal successively output, as well as the output timings of the latch signals LAT, LAT0, and LAT1. The middle portion of FIG. 8 shows the positions of the print head 28, with regard to the black (K) ink as an example, in the main scanning direction at respective timings 'a' through 'd'. Each circle shows the position of each nozzle. The lower portion of FIG. 8 shows the dots actually formed. Each rectangle defined by the dotted line represents a pixel, and each hatched circle represents a dot. The relationships between the driving waveforms and the resulting dots are separately shown with regard to the $0^{th}$ nozzle row and the $1^{st}$ nozzle row.

As described previously, the print data PD are input in synchronism with the latch signal LAT. In the structure of the embodiment, the driving waveforms are output in a specific cycle where four driving waveforms are allocated to each pixel. The latch signal LAT is output at a ratio of once to the output of four driving waveforms, in order to enable the input of the print data PD to be substantially synchronous with the period.

The latch signal LAT0, which controls the ink ejection timings from the $0^{th}$ nozzle row, is output at a ratio of once to the output of four driving waveforms. More specifically the latch signal LAT0 is output at the timing that enables dots to be formed in one pixel with the driving waveforms S1 through S4. In the example of FIG. 8, the latch signal LAT0 is output at the timing that printing starts from the time point when the print head 28 reaches the position defined by the timing 'a'.

The latch signal LAT1, which controls the ink ejection timings from the $1^{st}$ nozzle row, is output at a ratio of once to the output of four driving waveforms. The output timing of the latch signal LAT1 is regulated to minimize the misalignment of the dots formed by the $1^{st}$ nozzle row from the dots formed by the $0^{th}$ nozzle row. In the case where the $0^{th}$ nozzle row and the $1^{st}$ nozzle row have equivalent ink ejection characteristics, the output timing of the latch signal LAT1 is regulated to execute the ink ejection at the time point when the print head 28 reaches the position defined by the timing 'b'. Namely the ink ejection should be performed at the time point when the $1^{st}$ nozzle row reaches the position of the $0^{th}$ nozzle row at the timing 'a'. In the arrangement of this embodiment, the latch signal LAT1 is thus output with the driving waveform S3. The $1^{st}$ nozzle row accordingly creates dots with the driving waveforms S3 through S6.

The output timings of the latch signals LAT0 and LAT1 are stored in advance in the PROM. In the arrangement of this embodiment, the latch signal LAT0 is output at substantially the same timing as that of the latch signal LAT. The delay of the output timing of the latch signal LAT1 relative to the output timing of the latch signal LAT0 is accordingly stored as the dot formation timing into the PROM.

The printer PRT having the hardware structure described above carries out the main scan and causes the driving circuit to drive the respective piezoelectric elements PE provided for the ink ejection heads 61 through 66 of the print head 28, so as to generate a multi-color image on the sheet of printing paper P. The embodiment uses the printer PRT with the print head that ejects ink with the piezoelectric elements PRT. The arrangement of the present invention may use another printer that ejects ink according to a different technique. One applicable structure supplies electricity to a heater installed in an ink conduit and ejects ink with bubbles produced in the ink conduit. The principle of the present invention is also applicable to a variety of other printers, such as thermal transfer printers, sublimation printers, and dot impact printers.

(2) Control of Dot Formation

Figure 9:
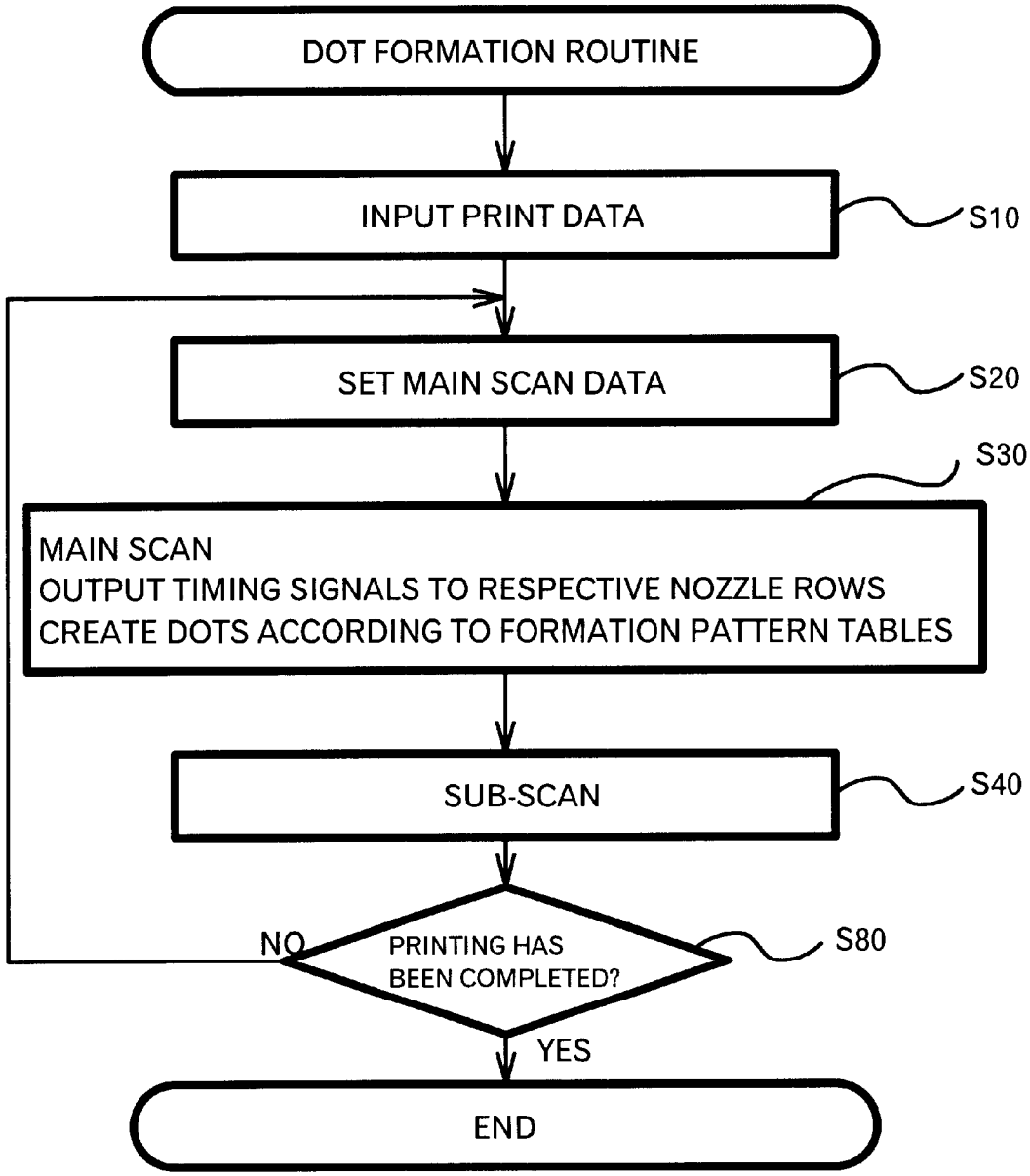
FIG. 9 is a flowchart showing a dot formation routine executed in the embodiment.

The following describes the dot formation process executed in this embodiment. FIG. 9 is a flowchart showing a dot formation routine, which is executed by the CPU in the control circuit 40. When the program enters the routine of FIG. 9, the CPU first inputs print data at step S10. The input print data, which have been processed by the computer PC, represent the densities to be expressed in the respective pixels included in an image with the color inks provided in the printer PRT and may take the values in the range of 0 through 4.

The CPU temporarily stores the input print data into the buffer. The CPU then outputs the data, which are to be output successively to the respective nozzles in one pass of the main scan, as main scan data to the driving circuit of the print head 28 at step S20. The main scan data are distributed to the $0^{th}$ and 1st nozzle rows and output to the first latch 41*a* of the $0^{th}$ nozzle row and the first latch 41*b* of the $1^{st}$ nozzle row. The same processing is carried out for all the color inks.

Figures 10, 11:
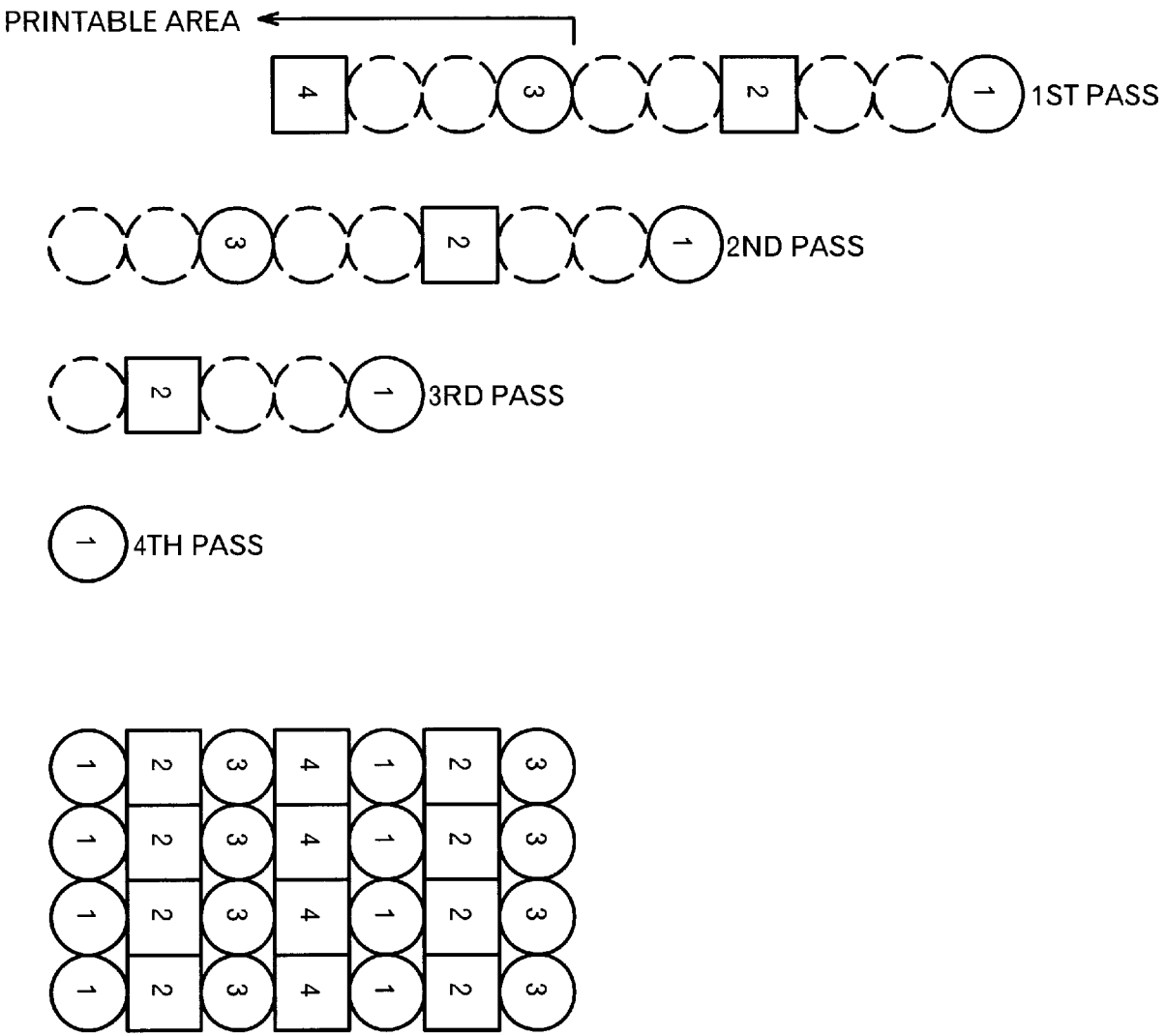
FIG. 10 shows the raster lines formed by the respective nozzles.
FIG. 11 shows an exemplified formation timing table.
Figure 12A:
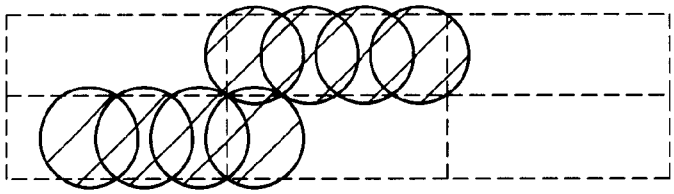
FIG. 12 shows the positional relations of dots formed at varied dot formation timings.
Figure 12B:
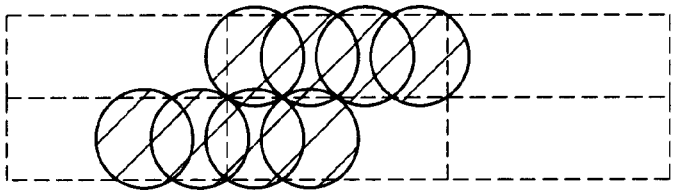
Figure 12C:
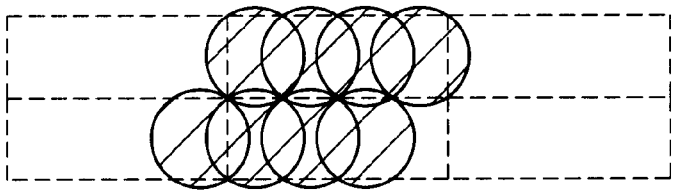
Figure 12D:
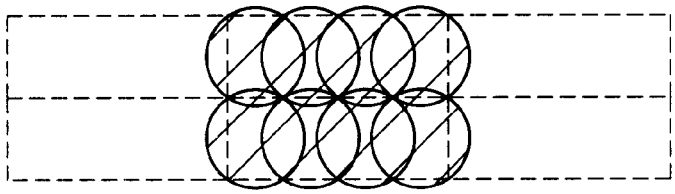
Figure 12E:
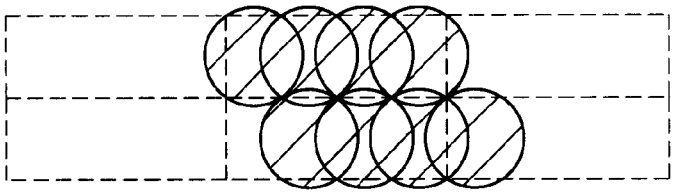
Figure 12F:
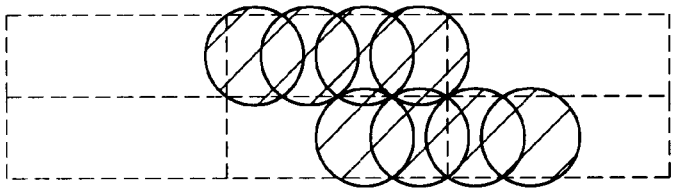
Figure 12G:
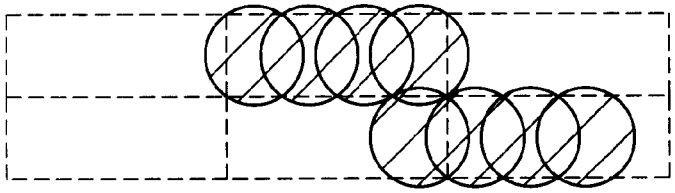

The relationship between the print data and the respective nozzle rows is unequivocally determined in connection with the quantities of sub-scan feed. FIG. 10 shows the raster lines formed by the respective nozzles. The left portion of FIG. 10 shows the positions of the print head in the sub-scanning direction at the $1^{st}$ through the $4^{th}$ passes of the main scan. For the clarity of illustration, this example uses the print head having four nozzles arranged at a nozzle pitch of 3 dots. The symbols 'O' and '⊗' represent the nozzles, and the encircled numerals denote the nozzle numbers allocated to the respective nozzles. The symbol 'O' represents the nozzles included in the $0^{th}$ nozzle row and the symbol '⊗' represents the nozzles included in the $1^{st}$ nozzle row.

The dots are formed by this print head while the sub-scan is carried out with a fixed quantity of sub-scan feed equivalent to 4 dots. The right portion of FIG. 10 shows the dots actually formed by the respective passes of the main scan. The symbols 'O' and '⊗' represent the dots actually formed. The numerals and the symbols correspond to the nozzle numbers and the nozzle rows forming the respective dots. An image is accordingly printed in a printable area as shown in FIG. 10. The $1^{st}$ nozzle and the $2^{nd}$ nozzle in the $1^{st}$ pass of the main scan and the $1^{st}$ nozzle in the $2^{nd}$ pass of the main scan do not form any dots, since there are no adjoining raster lines formed by the subsequent passes of the main scan.

The quantity of sub-scan feed is determined to print an image according to the nozzle interval and the number of nozzles. The raster lines are accordingly mapped to the nozzles, and the identification is carried out to determine whether each nozzle is included in the $0^{th}$ nozzle row or in the $1^{st}$ nozzle row. This example regards the print head having the specific number of nozzles arranged at the specific nozzle pitch. The mapping of the raster lines to the nozzles may, however, be performed with regard to any print head having an arbitrary number of nozzles arranged at an arbitrary nozzle pitch.

After outputting the print data distributed to the respective nozzle rows, the CPU shifts the print head to carry out one pass of the main scan and creates dots at step S30. The concrete procedure of step S30 is described previously with FIGS. 7 and 8. The process outputs the latch signals at the preset timings according to the respective nozzle rows to regulate the ink ejection timings, and creates dots based on the formation pattern tables stored in the pattern registers 44*a* and 44*b*. As described previously, the output timings of the latch signals are stored in the form of the formation timing table in the PROM. After the completion of one pass of the main scan, the CPU carries out sub-scan at step S40 and determines whether or not the printing has been completed at step S80. The CPU repeats the processing of steps S20 through S80 until the printing has been completed.

FIG. 11 shows an example of the formation timing table. In this embodiment, the formation timing table includes the dot formation timings individually set for the respective color inks. Each dot formation timing is specified as the number of driving waveforms. For example, with regard to the black (K) ink, the value '2' is set to the dot formation timing. This means that the latch signal LAT1 corresponding to the $1^{st}$ nozzle row is output with a delay of a time interval corresponding to two driving waveforms from the output of the latch signal LAT0 corresponding to the $0^{th}$ nozzle row. The value '2' corresponds to the timing adopted in FIG. 8. In a similar manner, the dot formation timings are stored with regard to the other color inks.

The dot formation timing is regulated in the following manner. The printer PRT regulates the dot formation timing between the $0^{th}$ nozzle row and the $1^{st}$ nozzle row in the unit of the time interval corresponding to the output of each driving waveform. In the arrangement of this embodiment, four driving waveforms are output in each pixel. Regulating the dot formation timing in the unit of the driving waveform thus finely adjusts the dot formation position in the unit of one-quarter of the width of each pixel.

FIG. 12 shows the positional relations of dots formed at varied dot formation timings. Each rectangle defined by the broken line corresponds to a pixel. FIG. 12A through FIG. 12G show the dots formed at seven different dot formation timings. The upper row shows the dots formed by the $0^{th}$ nozzle row, and the lower row shows the dots formed by the $1^{st}$ nozzle row. The dot formation timing of the $1^{st}$ nozzle row is successively delayed by one driving waveform, so that there are seven different positional relations of dot formation. Among the different dot formation timings resulting in these different positional relations of dot formation, the dot formation timing attaining the minimum misalignment in the main scanning direction is selected and stored in the formation timing table. In the example of FIG. 12, the dot formation timing of FIG. 12D is most referable.

(3) Regulation of Dot Formation Timing

Figure 13:
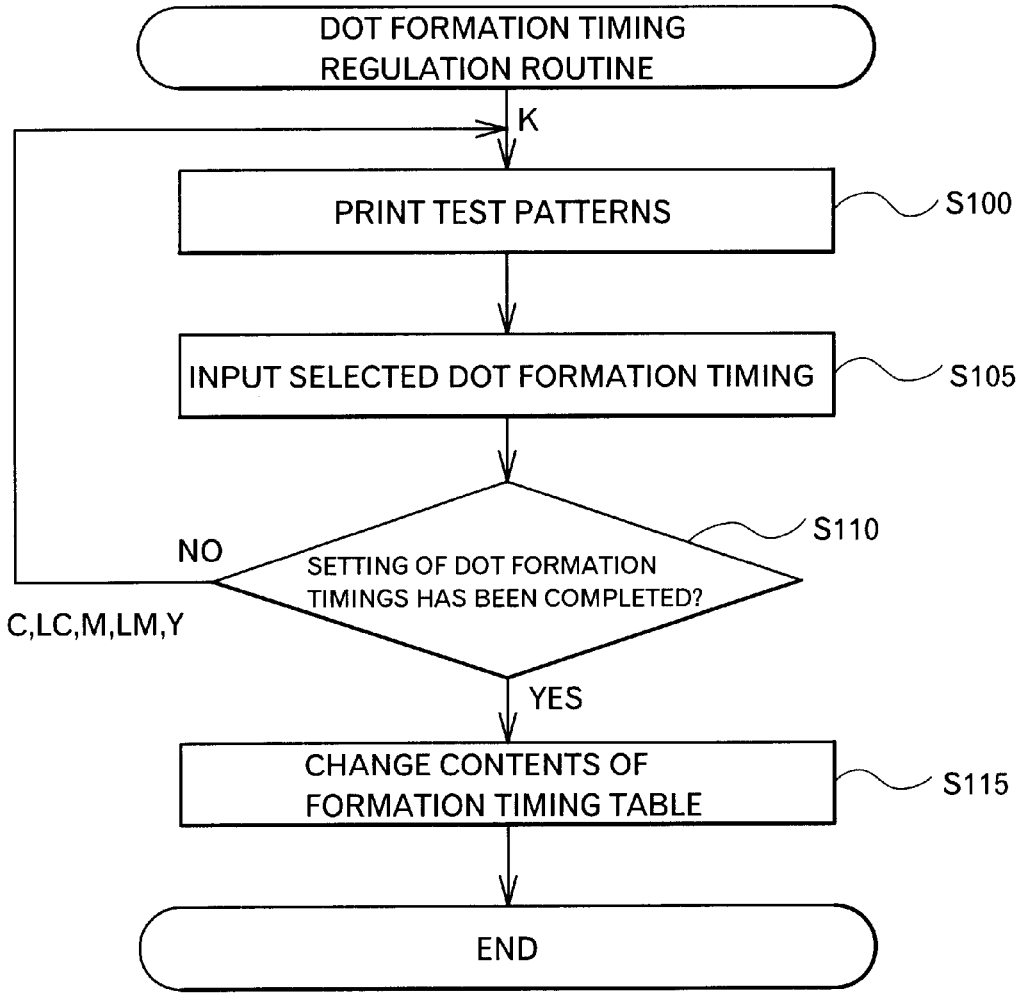
FIG. 13 is a flowchart showing a dot formation timing regulation routine executed in the embodiment.

The printing apparatus of this embodiment can regulate the dot formation timing using test patterns. The following describes the procedure of regulating the dot formation timing. FIG. 13 is a flowchart showing a dot formation timing regulation routine, which is executed by the CPU in the computer PC.

When the program enters the routine of FIG. 13, the CPU first regulates the dot formation timing with regard to the black (K) ink. In order to regulate the dot formation timing, the CPU first causes test patterns to be printed with regard to the black (K) ink at step S100. The data of the test patterns are stored in advance as the test pattern data 107 (see FIG. 2). The printer PRT receives the data of the test patterns and prints the test patterns.

Figure 14:
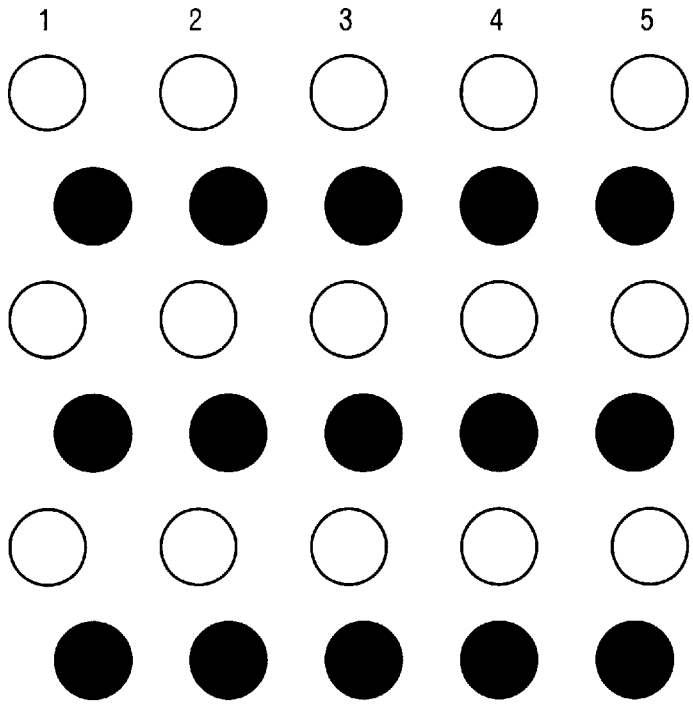
FIG. 14 shows an example of test patterns.

FIG. 14 shows an example of the test patterns. The open circles represent the dots formed by the $0^{th}$ nozzle row, and the closed circles represent the dots formed by the $1^{st}$ nozzle row. The test patterns are recorded by changing the dot formation timing of the $1^{st}$ nozzle row in five different stages defined by numerals of 1 through 5.

The user of the printer PRT compares these printed test patterns and selects the optimum dot formation timing that attains the most preferable image. The CPU inputs a value specifying the selected dot formation timing at step S105. In the example of FIG. 14, at the dot formation timing of No. 4, the recording positions of the dots formed by the $0^{th}$ nozzle row are substantially coincident with the recording positions of the dots formed by the $1^{st}$ nozzle row. In this case, the value '4' is accordingly input as the optimum dot formation timing. The input data is temporarily stored as the current dot formation timing.

The CPU then determines whether or not setting of the dot formation timing has been completed for all the color inks at step S110. In this embodiment, the dot formation timing should be regulated not only for the black ink but for all the other color inks. At this moment, the regulation of the dot formation timing has been completed only for the black ink. The CPU accordingly determines at step S110 that the setting of the dot formation timing has not yet been completed and shifts to the regulation of the dot formation timing with regard to the cyan (C) ink.

When the setting of the dot formation timing has been completed for all the color inks according to the procedure discussed above, the CPU changes the contents of the formation timing table at step S115. The concrete procedure of step S115 outputs the current dot formation timings temporarily stored at step S105 to the printer PRT and stores them in the PROM included in the control circuit 40.

Figure 15:
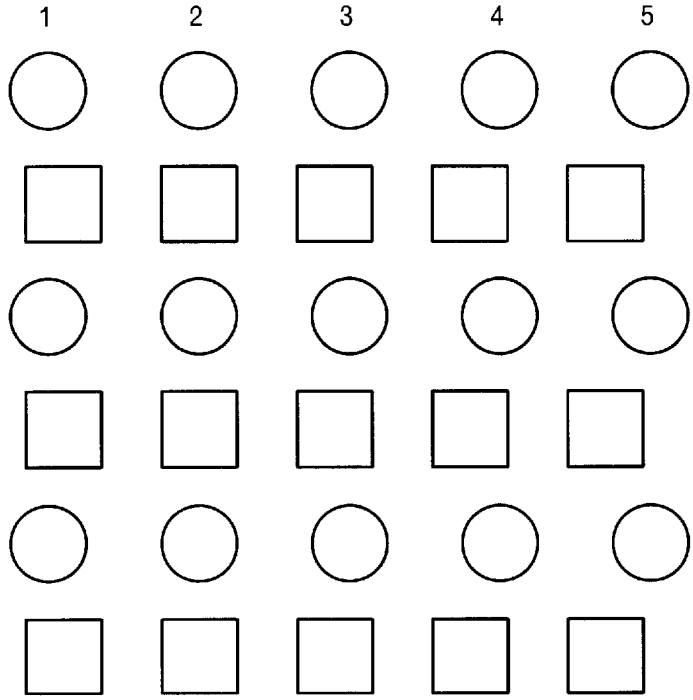
FIG. 15 shows test patterns used to regulate the dot formation timing between different color inks.

The technique of the embodiment regulates the dot formation timing between the $0^{th}$ nozzle row and the $1^{st}$ nozzle row with regard to each color ink. One preferable application further regulates the dot formation timing between different color inks. FIG. 15 shows test patterns used to regulate the dot formation timing between different color inks. The explanation regards an example of regulating the dot formation timing between the black ink and the cyan ink. The symbol 'O' represents the dots formed by the $0^{th}$ nozzle row with regard to the black ink, whereas the symbol '⊗' represents the dots formed by the $0^{th}$ nozzle row with regard to the cyan ink. The dot formation timing of the cyan ink is changed in five different stages. The optimum dot formation timing attaining the most preferable image is then selected among the dot formation timings of these test patterns. In the example of FIG. 15, the dot formation timing of No. 2 is most preferable. The selection of the dot formation timing No. 2 ensures the optimum regulation of the dot formation timing between the black ink and the cyan ink. In a similar manner, the dot formation timing may be regulated between the black ink and any one of the other color inks.

Figure 16:
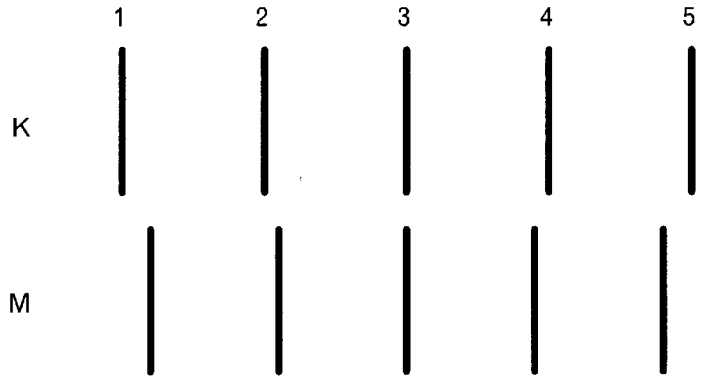
FIG. 16 shows another example of test patterns.

A variety of test patterns other than those shown in FIGS. 14 and 15 may be used to regulate the dot formation timing. FIG. 16 shows another example of the test patterns. This example regards the case of regulating the dot formation timing between the black ink and the magenta ink. In the example of FIG. 16, the test patterns are straight lines formed in the sub-scanning direction. The straight lines with the symbol 'K' in the upper row are formed with the black (K) ink at a fixed dot formation timing. The straight lines with the symbol 'M' in the lower row are formed with the magenta (M) ink at different dot formation timings shifted in a stepwise manner. At the optimum dot formation timing, the position of the straight line in the main scanning direction formed with the black ink is substantially coincident with the position of the straight formed with the magenta ink. In the example of FIG. 16, the dot formation timing No. 3 is most preferable. Although FIG. 16 regards the example of regulating the dot formation timing between different color inks, these test patterns are applicable to the case of regulating the dot formation timing between the $0^{th}$ nozzle row and the $1^{st}$ nozzle row with regard to each color ink. Any other test pattern that enables detection of the misalignment of dots may be used to regulate the dot formation timing.

The printing apparatus of the embodiment regulates the dot formation timing and thereby finely adjusts the positions of dots in the main scanning direction in the unit of a driving waveform. This arrangement minimizes the positional misalignment of dots in the main scanning direction formed by the respective nozzle rows, thereby attaining the high quality printing.

In the printing apparatus of the embodiment, the successively output driving waveforms relative to each pixel are specified for each nozzle row. This results in regulating the positions of dot formation. This arrangement does not require any additional hardware structure, such as a delay circuit that regulates the output timing of the driving waveform for each nozzle row, for regulating the positions of dot formation. The printing apparatus of the embodiment thus improves the picture quality of the resulting printed image without increasing the number of circuit elements and the manufacturing cost.

The printing apparatus of the embodiment may regulate the dot formation timings at any time in operation utilizing the test patterns. The positional misalignment of dots in the main scanning direction is ascribed not only to some errors in the manufacturing process but also to the time-based change of the mechanism and ink or other causes occurring in operation of the printing apparatus. The printing apparatus of the embodiment regulates the dot formation timing using the test patterns, so as to minimize the positional misalignment of dots occurring in operation of the printing apparatus. This arrangement enables the printing quality to be readily kept at a high level and significantly improves the convenience of the printing apparatus.

The above embodiment sets the on-off conditions of all the four driving waveforms W1 through W4 allocated to each pixel, so as to express the densities of the print data PD in the range of 0 to 5. The principle of the present invention may, however, be applied to another structure in which only part of the plurality of driving waveforms allocated to each pixel contributes to the expression of the densities. In other words, a greater number of driving waveforms than the required number of driving waveforms for expression of the densities according to the print data PD may be allocated to each pixel. This case is described below as a first modified example.

Figure 17:
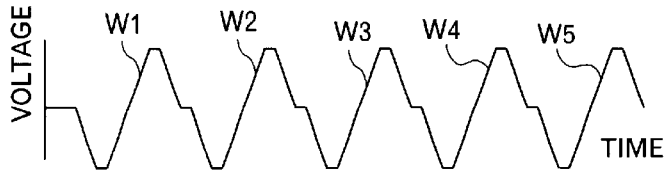
FIG. 17 shows mapping of the print data to the dot formation patterns in a first modified example.
Figure 17:
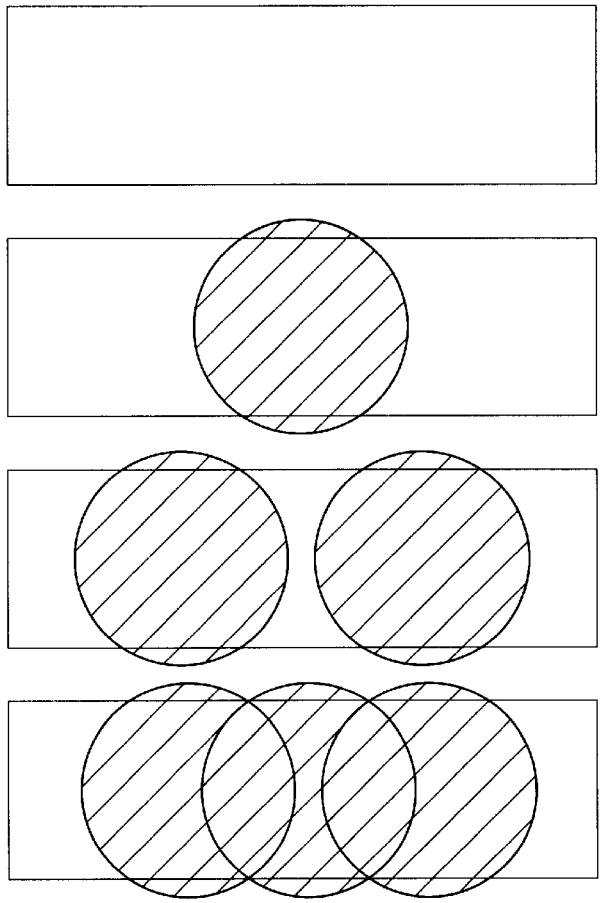
Figure 18A:
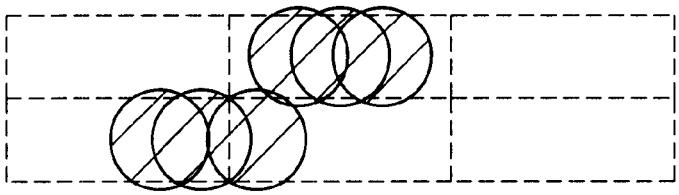
FIG. 18 shows the positional relations of dots formed at different dot formation timings in the first modified example.
Figure 18B:
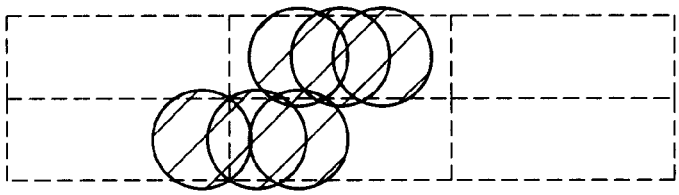
Figure 18C:
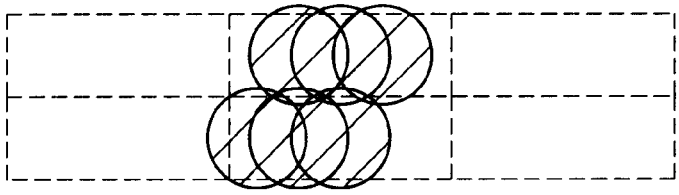
Figure 18D:
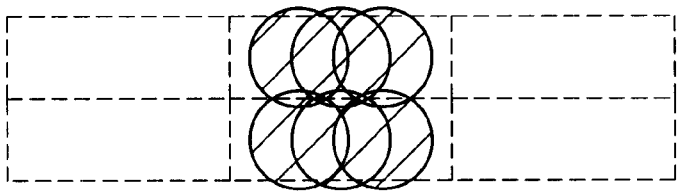
Figure 18E:
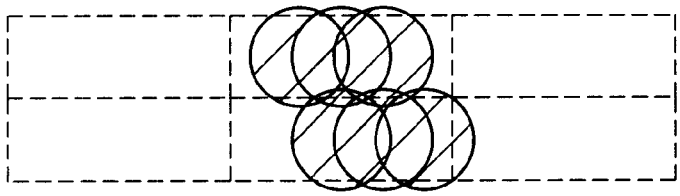
Figure 18F:
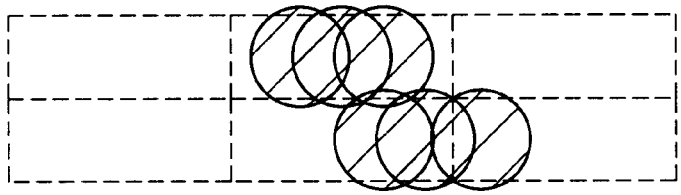
Figure 18G:
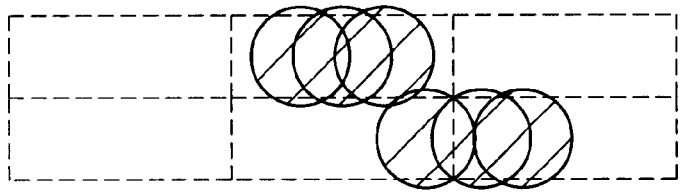

FIG. 17 shows mapping of the print data to the dot formation patterns in the first modified example. In the example of FIG. 17, five driving waveforms are allocated to each pixel. Unlike the above embodiment, the first modified example uses three out of the five driving waveforms to express the densities in the four levels. In other words, each pixel has two driving waveforms that do not contribute to the expression of densities corresponding to the print data PD.

FIG. 18A through FIG. 18G show the positional relations of dots formed at different dot formation timings in the first modified example. The example of FIG. 18 shows the case of dot formation when the print data PD is equal to 3. In the same manner as the above embodiment, the positions of dot formation can be regulated by changing the dot formation timing with the driving waveforms. In the first modified example, five driving waveforms are allocated to each pixel, and the positions of dot formation are thus regulated in the unit of one-fifth of the width of each pixel.

Figure 19A:
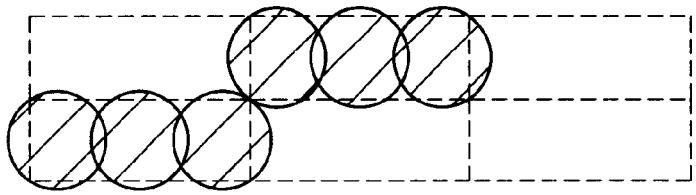
FIG. 19 shows the positional relations of dots when three driving waveforms are allocated to each pixel.
Figure 19B:
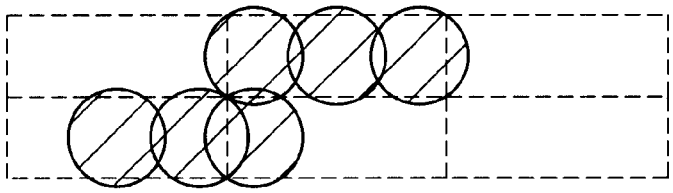
Figure 19C:
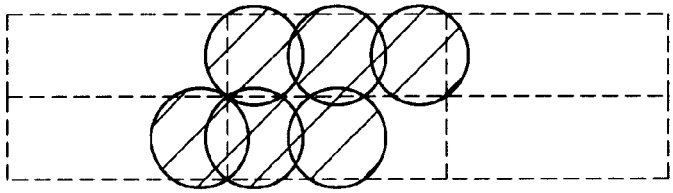
Figure 19D:
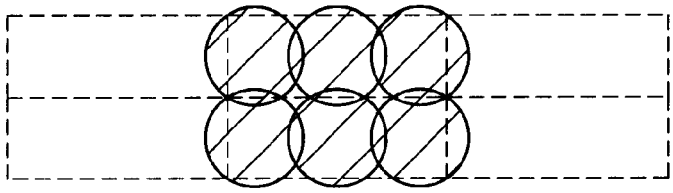
Figure 19E:
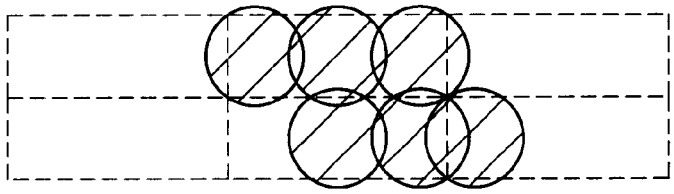
Figure 19F:
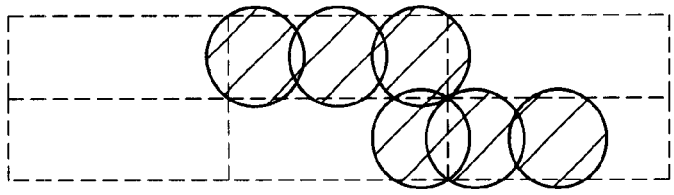
Figure 19G:
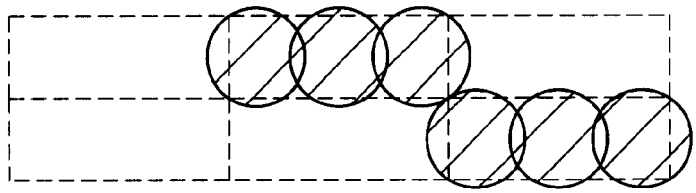

FIG. 19A through FIG. 19B shows the positional relations of dots when three driving waveforms are allocated to each pixel. In this case, since the three driving waveforms are allocated to each pixel, the positions of dot formation are regulated in the unit of one-third of the width of each pixel. As clearly understood from the comparison between FIG. 18 and FIG. 19, the first modified example enables the finer adjustment of the positions of dot formation and thereby further improves the picture quality.

The first modified example regards the case where five driving waveforms are allocated to each pixel and only three out of the five driving waveforms are used for expression of the densities. The number of driving waveforms allocated to each pixel and the number of driving waveforms actually used for formation of dots are, however, not restricted to these values, but may be set arbitrarily. As long as the number of the driving waveforms allocated to each pixel is greater than the number of the driving waveforms required for expression of the densities corresponding to the print data, the positions of dot formation can be adjusted according to the number of the driving waveforms allocated to each pixel.

The above embodiment and the first modified example regard the positional alignment between two nozzle rows with regard to an identical color ink. The principle of the present invention may, however, be applicable to adjust the positional misalignment of dots between different color inks. This case is described below as a second modified example.

Figure 20:
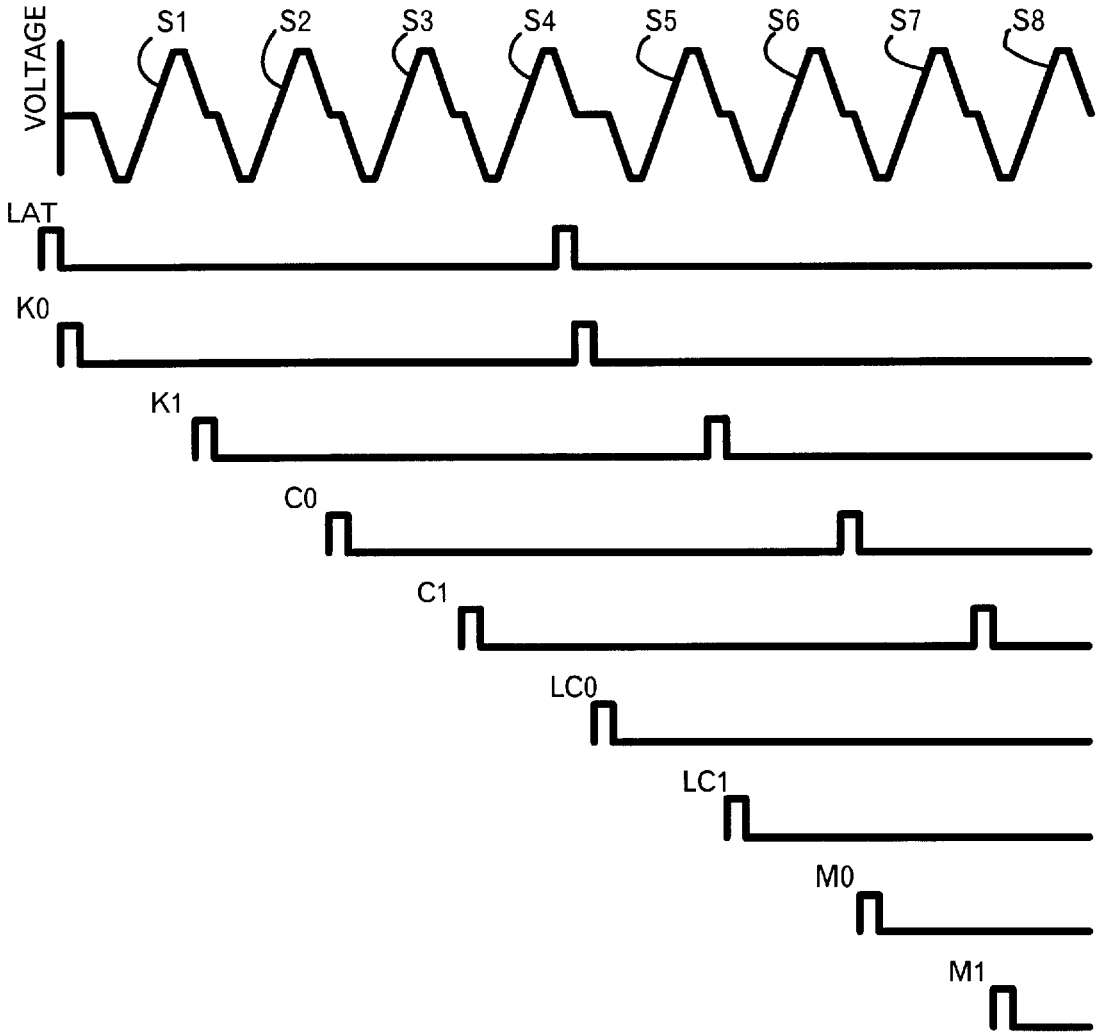
FIG. 20 shows the dot formation timings in a second modified example.

FIG. 20 shows the dot formation timings in the second modified example. In the second modified example, driving waveforms S1 through S8 shown in FIG. 20 are output commonly to all the nozzle rows of the respective color inks shown in FIG. 4. The timings of starting ink ejection with these driving waveforms are regulated using the latch signals with regard to the nozzle rows of the respective color inks. For convenience of illustration, FIG. 20 shows the latch signals for the black (K) ink, the cyan (C) ink, the light cyan (LC) ink, and the magenta (M) ink. The numeral '0' added to the right side of the symbol representing each color ink denotes the $0^{th}$ nozzle row, whereas the numeral '1' denotes the $1^{st}$ nozzle row. Regulating the output timing of the latch signal for each nozzle row enables adjustment of the positions of dot formation, based on the principle discussed in the above embodiment. The second modified example regards the case where each color ink has two nozzle rows. The number of nozzle rows and the number of color inks may, however, be varied according to the requirements.

The printing apparatus of the second modified example effectively adjusts the positional misalignment of dots without providing separate circuits for generating the driving waveforms with regard to each color ink and for regulating the output timings of the driving waveforms. This arrangement improves the picture quality of the resulting printed image without increasing the manufacturing cost of the printing apparatus.

(4) Second Embodiment

The first embodiment regards the structure in which dots are formed while the print head moves in one direction. The principle of the present invention may, however, be also applicable to a printing apparatus that forms dots in the course of both the forward pass and the backward pass of the print head, that is, the printing apparatus of bi-directional printing. The application to the printing apparatus of bi-directional printing is described below as a second embodiment according to the present invention.

Figure 21:
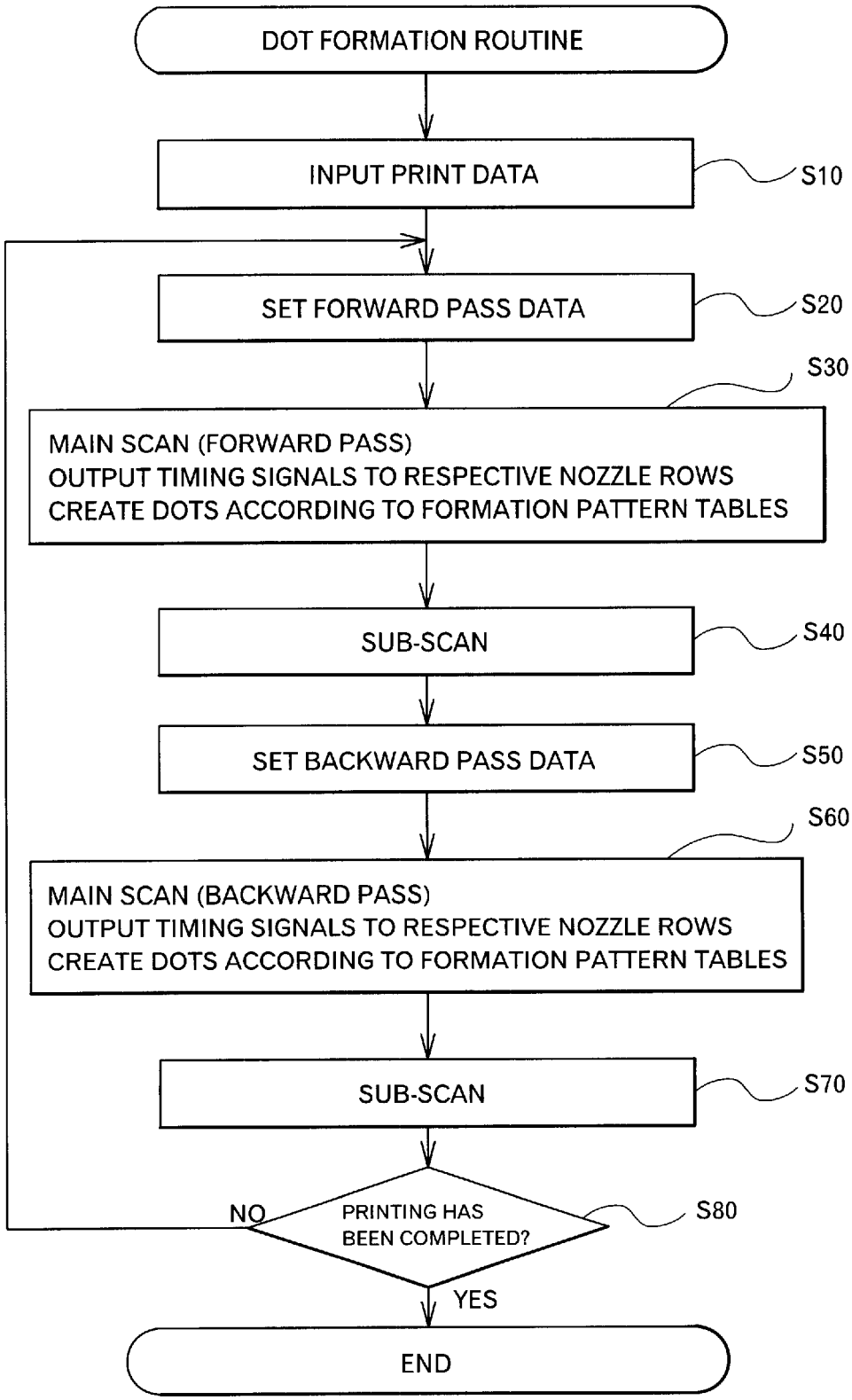
FIG. 21 is a flowchart showing a dot formation routine executed in a second embodiment of the present invention.

The printing apparatus of the second embodiment has the same hardware configuration as that of the first embodiment. The second embodiment carries out the bi-directional printing and thereby has a different dot formation routine from that executed in the first embodiment. FIG. 21 is a flowchart showing the dot formation routine executed by the CPU in the printer PRT in the second embodiment. When the program enters the dot formation routine of FIG. 21, the CPU first receives print data at step S10, sets the forward pass data at step S20, and creates dots in each pixel in the course of the forward pass of the main scan of the print head 28 at step S30. When the forward pass of the main scan is completed, the sub-scan is carried out at step S40. The processing of steps S10 through S40 in the second embodiment shown in FIG. 21 is practically the same as the processing of steps S10 through S40 in the first embodiment shown in FIG. 9. A formation timing table set for the forward pass is used here for printing.

In the printing apparatus of the second embodiment, after the completion of the sub-scan feed, the CPU sets the backward pass data at step S50 and creates dots in each pixel in the course of the backward pass of the main scan of the print head 28 at step S60. When the backward pass of the main scan is completed, the sub-scan is carried out at step S70. Since the print head 28 moves in the reverse direction, the arrangement of the print data in the backward pass is reverse to the arrangement of the print data in the forward pass. Otherwise the processing for the backward pass is identical with the processing for the forward pass, except that a formation timing table set for the backward pass is used here for printing. The processing of steps S20 through S70 is repeatedly executed until printing of an image has been completed at step S80.

Figure 22A:
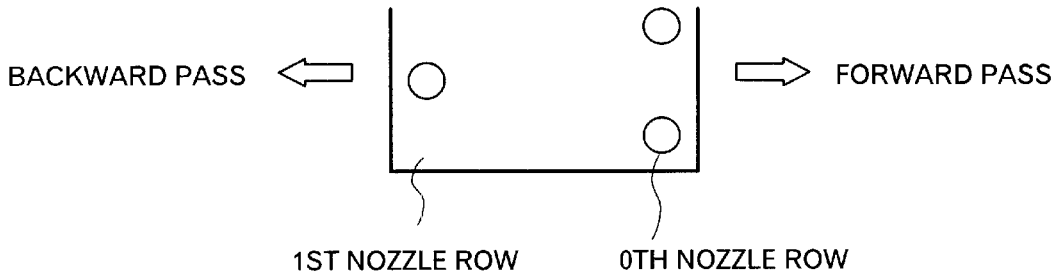
FIG. 22 shows the relationship between the moving direction of the carriage and the dot formation timing.

The processing of the second embodiment utilizes different formation timing tables for the forward pass and for the backward pass, because of the following reasons. FIG. 22 shows the relationship between the moving direction of the carriage and the dot formation timing. In the case of the bi-directional printing, the $0^{th}$ nozzle row precedes the $1^{st}$ nozzle row in the forward pass of the printing as shown in FIG. 22A. The $1^{st}$ nozzle row precedes the $0^{th}$ nozzle row, however, in the backward pass of the printing.

Figure 22B:
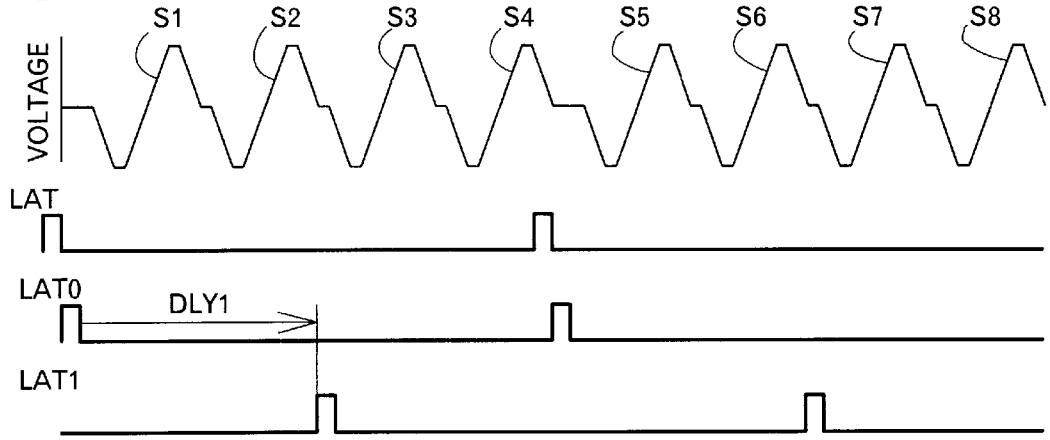

FIG. 22B shows the driving waveforms and the latch signals in the forward pass. The symbols in FIG. 22B have the same meanings as those in FIG. 8. In the same manner as described in FIG. 8, the print head 28 moves rightward (in the drawing) to create dots in the forward pass. The latch signal LAT1 for the $1^{st}$ nozzle row is accordingly output with a delay of a predetermined dot formation timing DLY1 from the output of the latch signal LAT0 for the $0^{th}$ nozzle row, which is the preceding nozzle row. The dot formation timing DLY1 is set in the manner discussed in the first embodiment with FIG. 8.

Figure 22C:
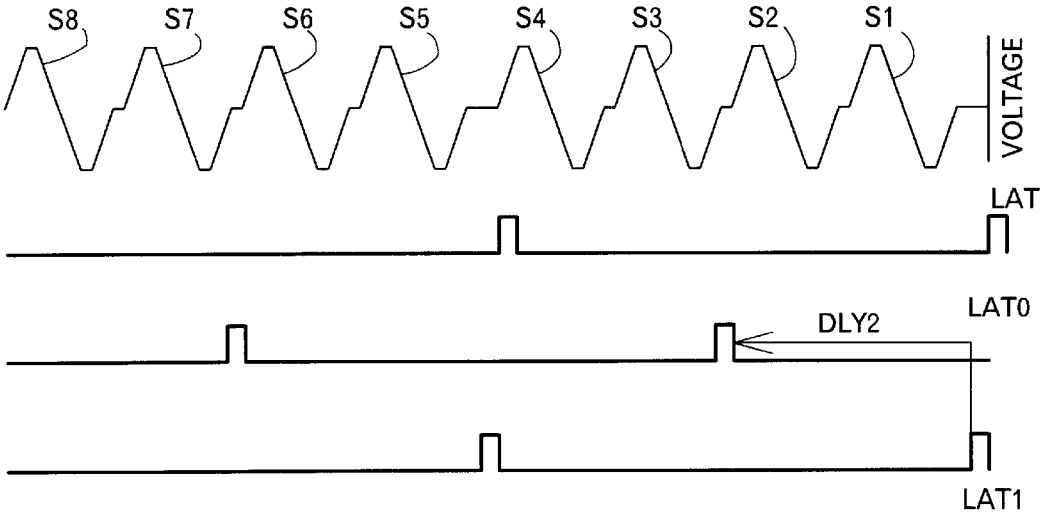

FIG. 22C shows the driving waveforms and the latch signals in the backward pass. The print head 28 moves leftward (in the drawing) to create dots in the backward pass. In FIG. 22C, the time scale goes from right to left, following the moving direction of the print head 28. In the backward pass, the latch signal LAT1 for the $1^{st}$ nozzle row, which is the preceding nozzle row, is output first, and the latch signal LAT0 for the $0^{th}$ nozzle row, which is the following nozzle row, is output with a delay of a predetermined dot formation timing DLY2 from the latch signal LAT1.

Since the preceding nozzle row in the forward pass is reverse to the preceding nozzle row in the backward pass, the output timings of the latch signals LAT0 and LAT1 are inverted. The dot formation timings DLY1 and DLY2 may be the same or different time intervals. This is because the inversion of the main scanning direction may cause variations in effects of the ink ejection characteristics and the backlash on the positions of dot formation.

The arrangement of the second embodiment accordingly provides the two separate formation timing tables (shown in FIG. 11) for the forward pass and the backward pass. The process selects the adequate formation timing table according to the moving direction of the print head 28 to set the output timings of the latch signals LAT0 and LAT1 and creates dots.

The printing apparatus of the second embodiment enables the adjustment of the positions of dot formation in the case of the bi-directional printing. This arrangement significantly improves the picture quality of the resulting printed image while ensuring the high-speed printing in the bi-directional printing mode.

Like the first embodiment, there may be many possible modifications in the case of the bi-directional printing. One possible modification causes the greater number of driving waveforms than the required number of driving waveforms for expression of the densities corresponding to the print data to be allocated to each pixel. Like the first modified example of the first embodiment discussed above, this modification enables the finer adjustment of the positions of dot formation. This modification is discussed below as a third modified example.

Figure 23:
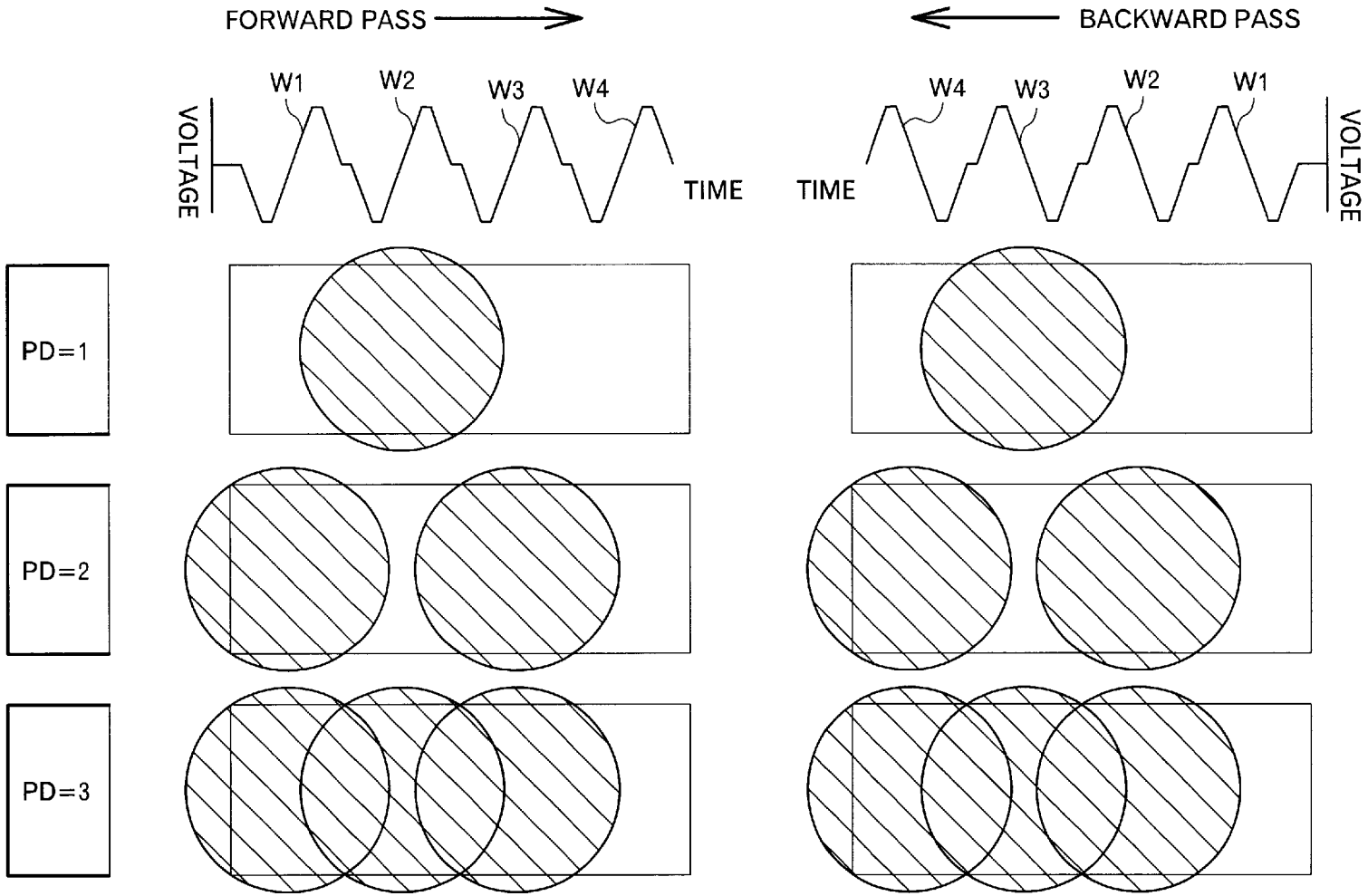
FIG. 23 shows mapping of the print data to the dot formation patterns in a third modified example.

FIG. 23 shows mapping of the print data to the dot formation patterns in the third modified example. In the third modified example, four driving waveforms are allocated to each pixel. As shown in FIG. 23, the technique of the third modified example uses three out of the four driving waveforms to express the densities in four levels. The case of the print data PD=0 where all the driving waveforms are off is omitted from the illustration.

The left portion of FIG. 23 shows the dot formation patterns in the forward pass of the main scan. The mapping of the values of the print data PD to the on-off conditions of driving waveforms W1 through W4 in the forward pass is given below:

PD=0→W1=OFF, W2=OFF, W3=OFF, W4=OFF;
PD=1→W1=OFF, W2=ON, W3=OFF, W4=OFF;
PD=2→W1=ON, W2=OFF, W3=ON, W4=OFF; and
PD=3→W1=ON, W2=ON, W3=ON, W4=OFF.

According to the number of the driving waveforms allocated to each pixel, the center of gravity of the dots created in each pixel may not be coincident with the center of the pixel as shown in FIG. 23. In such cases, it is desirable to change the mapping of the print data to the dot formation patterns in the backward pass from that in the forward pass.

The right portion of FIG. 23 shows the dot formation patterns in the backward pass of the main scan. The mapping of the values of the print data PD to the on-off conditions of the driving waveforms W1 through W4 in the backward pass is given below:

PD=0→W1=OFF, W2=OFF, W3=OFF, W4=OFF;
PD=1→W1=OFF, W2=OFF, W3=ON, W4=OFF;
PD=2→W1=OFF, W2=ON, W3=OFF, W4=ON; and
PD=3→W1=OFF, W2=ON, W3=ON, W4=ON.

In the case of the bi-directional printing, the output driving waveforms relative to the pixel in the forward pass are different from those in the backward pass as shown in FIG. 23. In this case, the process provides the two separate formation pattern tables 114 for the forward pass and for the backward pass and changes the dot formation patterns in the backward pass from those in the forward pass. This arrangement enables the dots to be adequately formed in the respective pixels according to the print data. The technique of the third modified example regulates the dot formation timings in the forward pass and in the backward pass of the main scan, based on the dot formation patterns provided separately for the forward pass and the backward pass. This arrangement enables the finer adjustment of the positions of dot formation both in the forward pass and in the backward pass of the main scan in the unit of a driving waveform.

The third modified example creates dots using part of the driving waveforms allocated to each pixel. The arrangement of changing the dot formation patterns in the forward pass and in the backward pass may also be applicable to the second embodiment that creates dots using all the driving waveforms allocated to each pixel. In the event that the dots formed in one pixel are symmetrical in the main scanning direction as shown in FIG. 23, it is not necessary to change the dot formation patterns according to the direction of the main scan. Adjustment of the positions of dot formation according to the dot formation timings also ensures the adequate dot formation.

The technique of the second embodiment is not restricted to the adjustment of the positional misalignment of dots formed by two nozzle rows with regard to each color ink but is also applicable to the case of adjusting the positional misalignment of dots between different color inks like the second modified example of the first embodiment. In the case of the bi-directional printing, the technique of the second embodiment may be applicable to the structure having only a single nozzle row in the main scanning direction. As described previously, in the case of the bi-directional printing, there is often a positional misalignment between the dots formed in the forward pass and the dots formed in the backward pass. This positional misalignment of dots occurs not only in the structure having a plurality of nozzle rows in the main scanning direction but in the structure having only a single nozzle row in the main scanning direction. The technique of the second embodiment is thus applicable to the printing apparatus with a print head having only a single nozzle row in the main scanning direction, for example, the printing apparatus in which the dot formation timing is adjustable with regard to each color ink and which has a print head having only one nozzle row with regard to each color ink in the main scanning direction.

In the second embodiment discussed above, the test patterns as shown in FIGS. 14 through 16 may be used to regulate the dot formation timings. In the examples of FIGS. 14 through 16, the test patterns are printed by combining the dots formed by the $0^{th}$ nozzle row with the dots formed by the $1^{st}$ nozzle row. In the second embodiment, on the other hand, the test patterns may be printed by combining the dots formed in the forward pass of the main scan with the dots formed in the backward pass. For example, in the example of FIG. 14, the dots defined by the open circles are formed in the forward pass, whereas the dots defined by the closed circles are formed in the backward pass. This arrangement enables the positions of dot formation to be readily adjusted in the case of the bi-directional printing.

In the case where there are two nozzle rows in the main scanning direction, one applicable process may adjust first the positional misalignment of dots between the $0^{th}$ nozzle row and the $1^{st}$ nozzle row in the forward pass of the main scan and then the positional misalignment of dots between the forward pass and the backward pass with regard to the $0^{th}$ nozzle row. The values obtained in the latter half of the adjustment procedure with regard to the $0^{th}$ nozzle row are applicable to the regulation of the dot formation timings of the $1^{st}$ nozzle row in the backward pass. The positional misalignment of dots between the forward pass and the backward pass with regard to the $1^{st}$ nozzle row may otherwise be adjusted independently.

(5) Third Embodiment

The first embodiment regards the case in which the identical driving waveform is output successively. The principle of the present invention is, however, also applicable to a printer that outputs different types of driving waveforms in a periodic manner. The application to such a printer is described below as a third embodiment according to the present invention.

Figure 24:
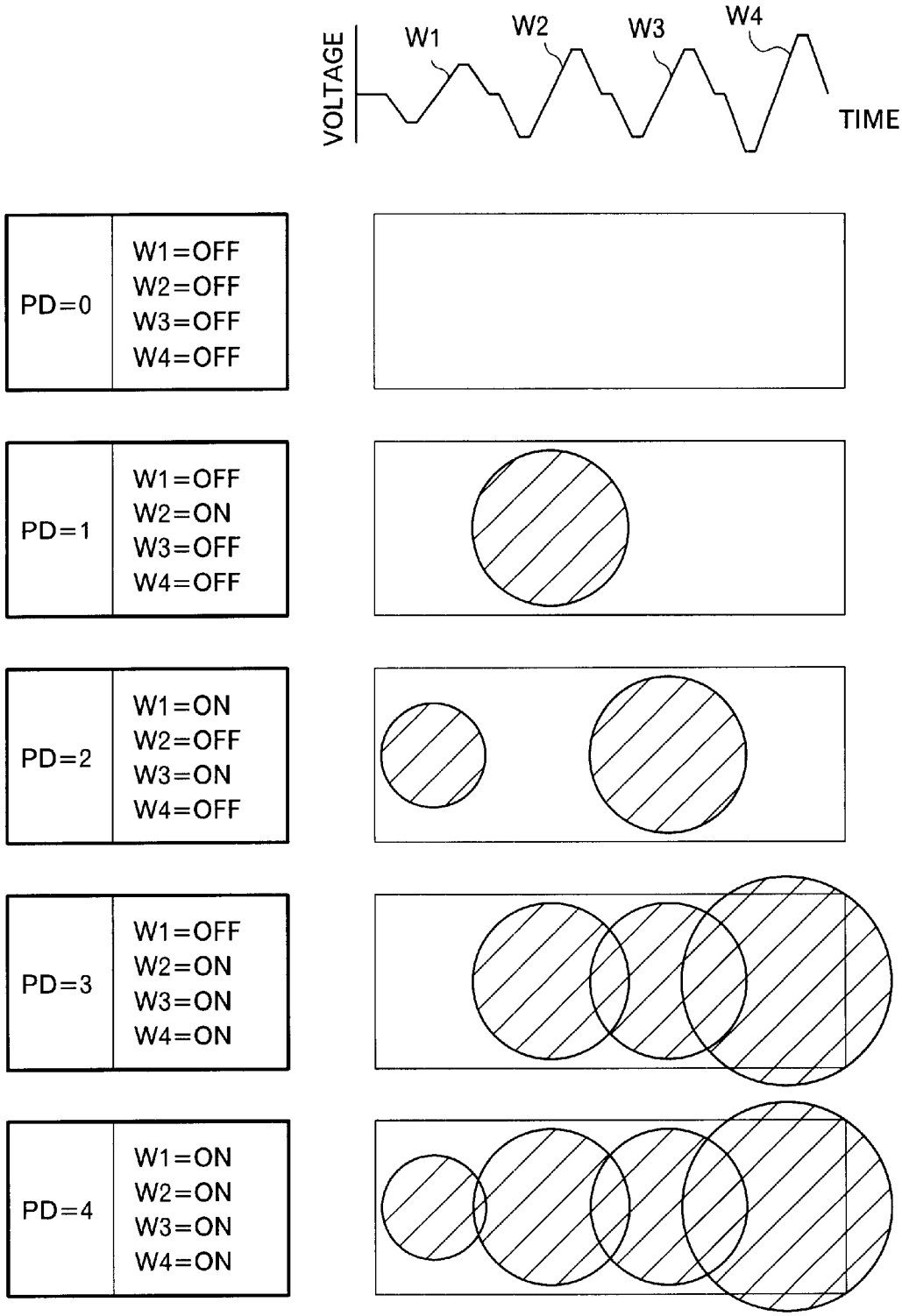
FIG. 24 shows mapping of the print data to the dot formation patterns in a third embodiment of the present invention.

The printing apparatus of the third embodiment has the identical hardware configuration with that of the printing apparatus of the first embodiment. The difference from the first embodiment is that the technique of the third embodiment uses different types of driving waveforms. FIG. 24 shows mapping of the print data to the dot formation patterns in the third embodiment. In the third embodiment, four driving waveforms W1 through W4 are allocated to each pixel. The three different types of driving waveforms are periodically output; the signal W1 for creating a smallest-diametral dot (small-size dot), the signals W2 and W3 for creating an intermediate-diametral dot (medium-size dot), and a signal W4 for creating a largest-diametral dot (large-size dot).

When the print data PD is equal to 0, all the driving waveforms W1 through W4 are set off, so that no dot is created. When the print data PD is equal to 1, only the driving waveform W2 is set on, so that one medium-size dot is formed. When the print data PD is equal to 2, the driving waveforms W1 and W3 are set on, so that one small-size dot and one medium-size dot are formed. When the print data PD is equal to 3, only the driving waveform W1 is set off, so that two medium-size dots and one large-size dot are formed. When the print data PD is equal to 4, all the driving waveforms W1 through W4 are set on, so that one small-size dot, two medium-size dots, and one large-size dot are formed.

Figure 25:
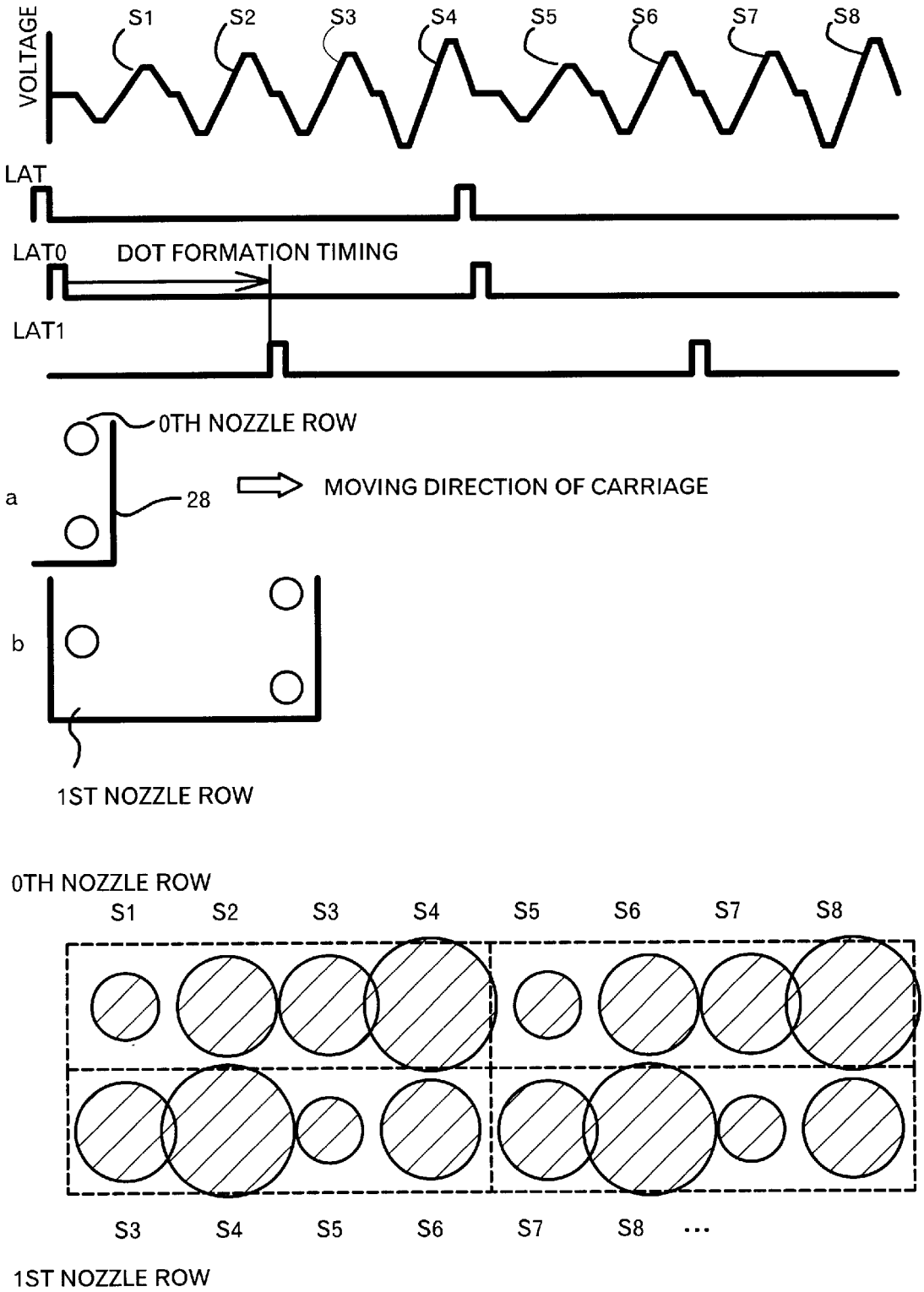
FIG. 25 shows the relationship between the driving waveforms and the dot formation timings in the third embodiment.

FIG. 25 shows the relationship between the driving waveforms and the dot formation timings in the third embodiment. As described previously, the technique of the third embodiment uses the three different types of driving waveforms output in a periodic manner. Driving signals S1 and S5 correspond to the driving waveform W1 for creating the small-size dot. Driving signals S2, S3, S6, and S7 correspond to the driving waveforms W2 and W3 for creating the medium-size dot. Driving signals S4 and S8 correspond to the driving waveform W4 for creating the large-size dot.

In one example, the dot formation timings are set in such a manner that the driving signals S1 through S4 are allocated to the $0^{th}$ nozzle row to create dots, whereas the driving signals S3 through S6 are allocated to the $1^{st}$ nozzle row to create dots. The lower portion of FIG. 25 shows the relationships between the driving signals and the resulting dots formed in each pixel with regard to the $0^{th}$ nozzle row and the $1^{st}$ nozzle row. As shown in this drawing, the arrangement of the small-size dot, the medium-size dots, and the large-size dot in each pixel in the case of the $0^{th}$ nozzle row is different from that in the case of the $1^{st}$ nozzle row.

The difference in arrangement of the dots does not significantly affect the density to be expressed in each pixel. For example, it is assumed that a small-size dot is formed in the left pixel of FIG. 25. In the case of the $0^{th}$ nozzle row, the first driving signal S1 among all the allocated driving signals should be used to create the small-size dot. In the case of the $1^{st}$ nozzle row, on the other hand, the third driving signal S5 among all the allocated driving signals should be used to create the small-size dot. Namely it is required to change the mapping of the values of the print data PD to the on-off conditions of the four driving waveforms allocated to each pixel, that is, the formation pattern table, with regard to the $1^{st}$ nozzle row from that with regard to the $0^{th}$ nozzle row.

Figure 26:
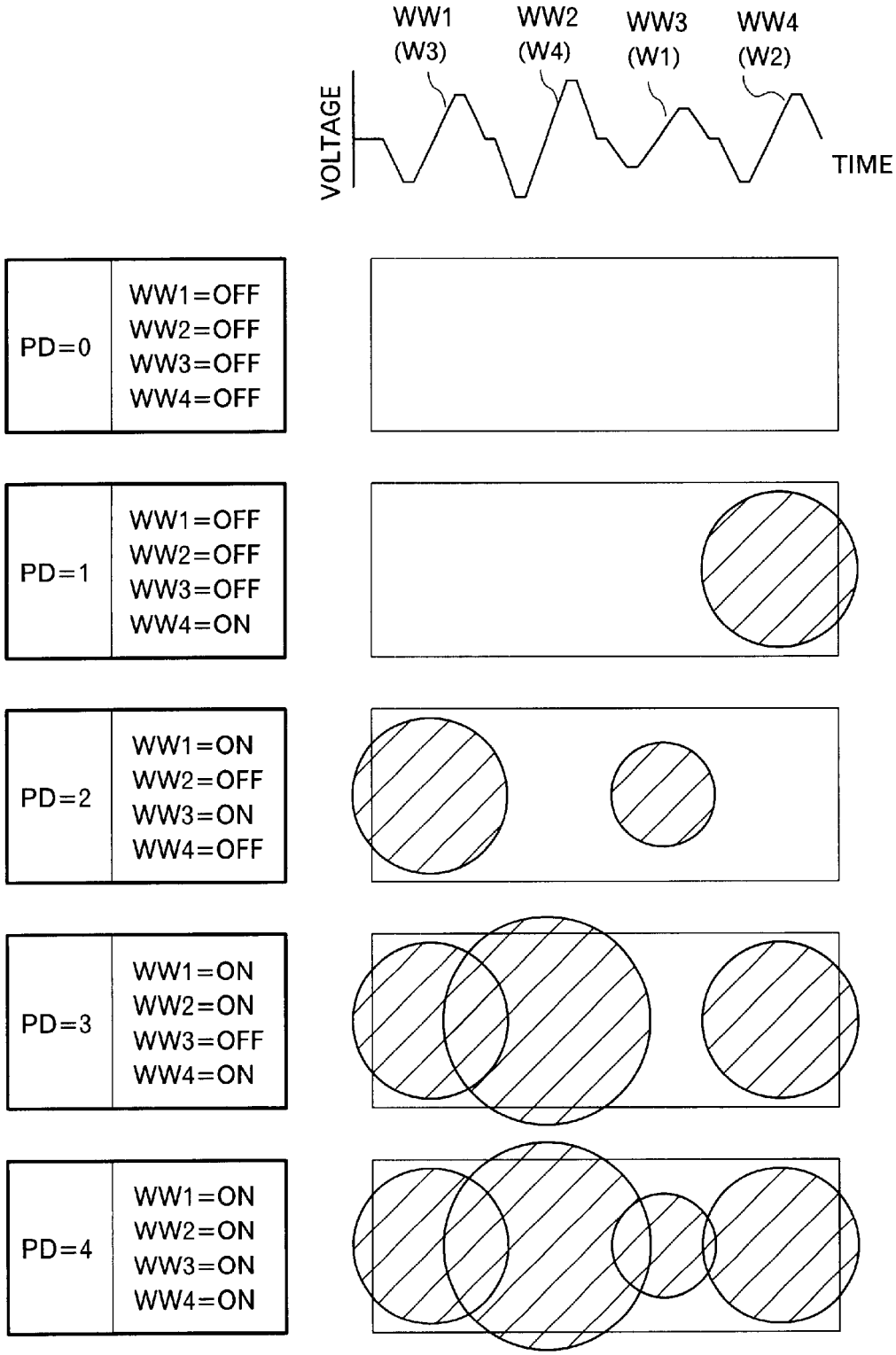
FIG. 26 shows the dot formation patterns with regard to the $1^{st}$ nozzle row in the third embodiment.
Figure 27:
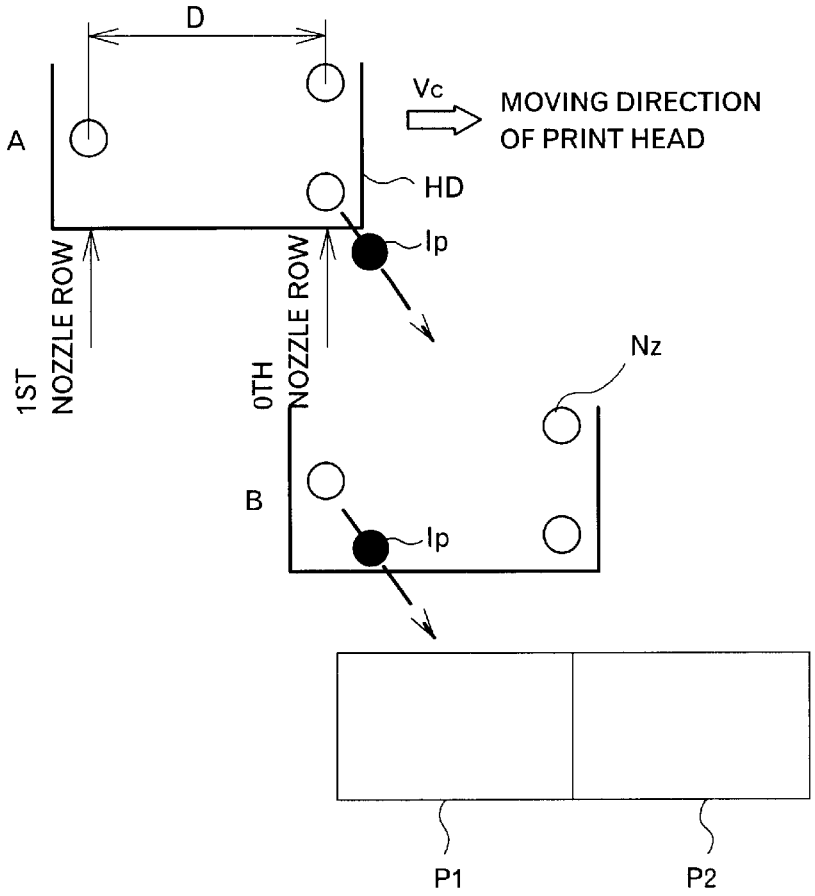
FIG. 27 shows a process of printing with a head having a plurality of nozzle rows.
Figure 28:
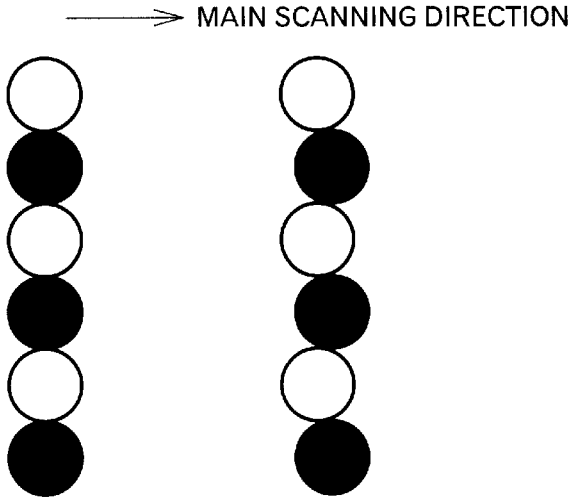
FIG. 28 shows the effects of a positional misalignment of dots in the main scanning direction on the picture quality.

FIG. 26 shows the dot formation patterns with regard to the $1^{st}$ nozzle row. When the dot formation timings are set as shown in FIG. 25, in the case of the $1^{st}$ nozzle row, the driving waveforms W3, W4, W1, and W2 are output in this sequence in each pixel. The formation pattern table here specifies the on-off conditions of four driving waveforms WW1, WW2, WW3, and WW4 that are output successively to each pixel. The driving waveforms WW1, WW2, WW3, and WW4 correspond to the driving waveforms W3, W4, W1, and W2, respectively.

Under the above conditions, the dot formation patterns corresponding to the respective values of the print data PD are set in the following manner, in order to enable expression of the corresponding densities in each pixel. When the print data PD is equal to 0, no dot is to be formed, so that all the driving waveforms WW1 through WW4 are set off. When the print data PD is equal to 1, one medium-size dot is to be formed, so that only the driving waveform WW4 is set on. When the print data PD is equal to 2, one small-size dot and one medium-size dot are to be formed, so that the driving waveforms WW1 and WW3 are set on. When the print data PD is equal to 3, two medium-size dots and one large-size dot are to be formed, so that only the driving waveform WW3 is set off. When the print data PD is equal to 4, one small-size dot, two medium-size dots, and one large-size dot are to be formed, so that all the driving waveforms WW1 through WW4 are set on.

In the third embodiment, the dot formation patterns shown in FIG. 24 are stored in the pattern register 44*a* of the $0^{th}$ nozzle row in the circuit structure of FIG. 7. The dot formation patterns shown in FIG. 26 are, on the other hand, stored in the pattern register 44*b* of the $1^{st}$ nozzle row. Storing the dot formation patterns corresponding to the sequence of the driving waveforms output to each pixel with regard to the respective nozzle rows enables the densities specified by the print data PD to be expressed adequately in the respective pixels.

The technique of the third embodiment uses the different types of driving waveforms to create dots, so as to enable expression of the densities in a wide range in the respective pixels. This arrangement ensures the smoother tone expression and effectively prevents the positional misalignment of dots in the main scanning direction, thereby attaining the high quality printing. The third embodiment regards the case in which four driving signals including three different types are allocated to each pixel.

The principle of the present invention is, however, applicable to any other cases in which an arbitrary number of driving waveforms including an arbitrary number of different types are allocated to each pixel. Like the first modified example discussed above, the greater number of driving waveforms than the required number of driving waveforms for expression of densities corresponding to the print data may be allocated to each pixel. In this case, the excess driving waveform may be any of the driving waveforms shown in FIG. 24. It is, however, desirable to output the four driving waveforms shown in FIG. 24 in a periodic manner.

Like the second embodiment discussed above, the technique of the third embodiment is also applicable to the case of the bi-directional printing. In this case, it is desirable to change the dot formation patterns in the backward pass from those in the forward pass to an allowable extent as described above in the third modified example. In the case of the bi-directional printing, the technique of the third embodiment is applicable whether the print head has only a single nozzle row or a plurality of nozzle rows in the main scanning direction.

The third embodiment regards the structure having two nozzle rows with regard to each color ink. The technique of the third embodiment is also applicable to the case of adjusting the positional misalignment of dots between different color inks like the second modified example of the first embodiment.

The present invention is not restricted to the above embodiments or their modifications, but there may be many other modifications, changes, and alterations without departing from the scope or spirit of the main characteristics of the present invention. The embodiment discussed above regulates the dot formation timings at any time in operation of the printing apparatus using the test patterns. The principle of the present invention may, however, be applicable to the structure having fixed dot formation timings. The embodiment discussed above enables expression of multilevel tones in each pixel. The principle of the present invention may, however, be applicable to the structure enabling expression of only two-level tones in each pixel, for example, 'formation of no dot' and 'formation of all dots'. The variety of control procedures described in the above embodiments may be attained by the hardware structure or alternatively by the software programs.

The scope and spirit of the present invention are limited only by the terms of the appended claims.

What is claimed is:

1. A printing apparatus comprising:

a print head having at least one dot forming element configured to form a dot, the print head being configured to move forward and backward relative to a printing medium;

a driving signal output unit configured to periodically output a plurality of series of driving signals to said at least one dot forming element in a specific cycle, each series of driving signals being allocated to a respective one of pixels;

an input unit configured to input print data which represent a density to be expressed in respective of the pixels;

a timing storage unit configured to store a specific relation between each series of driving signals and a dot forming condition; and a head drive unit configured to control an on-off condition of each series of driving signals to form a dot in respective of the pixels according to the input print data based on the specific relation stored in said timing storage unit while the print head is moving forward and backward relative to the printing medium.

2. A printing apparatus in accordance with claim 1, wherein:

said at least one dot forming element comprises a plurality of dot forming elements each configured to form a dot in response to the driving signal, said plurality of dot forming elements being arranged in the main scanning direction;

said driving signal output unit is configured to output a common driving signal to said plurality of dot forming elements; and said timing storage unit is configured to store the specific relation with regard to each of said plurality of dot forming elements arranged in the main scanning direction.

3. A printing apparatus in accordance with claim 1, wherein:

said timing storage unit is configured to store the specific relation with regard to each of a forward pass and a backward pass of the main scan; and said head drive unit is configured to drive said print head in both the forward pass and the backward pass of the main scan.

4. A printing apparatus in accordance with claim 3, wherein said head drive unit is configured to change the on-off condition of each series of driving signals in the backward pass of the main scan from the on-off condition of each series of driving signals in the forward pass.

5. A printing apparatus in accordance with claim 1, wherein said head drive unit is configured to attain a first state in which all the plurality of series of driving signals allocated to the pixels are on in a process of dot formation in the pixels.

6. A printing apparatus in accordance with claim 1, wherein said head drive unit is configured to attain a second state in which at least part of the plurality of series of driving signals allocated to the pixels is always off in a process of dot formation in the pixels.

7. A printing apparatus in accordance with claim 1, wherein the plurality of driving signals are of an identical type.

8. A printing apparatus in accordance with claim 1, wherein:

said driving signal output unit is configured to output different types of the series of driving signals allocated respective of the pixels; and said head drive unit is configured to change the on-off condition of each series of driving signals according to the specific relation stored in said timing storage unit.

9. A printing apparatus in accordance with claim 1, wherein said at least one dot forming element is configured to eject ink to form a dot.

10. A printing apparatus in accordance with claim 9, wherein said at least one dot forming element is configured to eject ink in response to a deflection occurring on application of a voltage as each one of the driving signals to a piezoelectric element so as to form a dot.

11. A printing apparatus in accordance with claim 1, further comprising:

a test pattern printing unit configured to print a test pattern which is used to detect a relative positional misalignment of dots formed by said print head in the main scanning direction; and a timing setting unit configured to set the specific relation stored in said timing storage unitbased on the printed test pattern.

12. A method of printing an image in which a print head with at least one dot forming element carries out a main scan by moving forward and backward relative to a printing medium in a predetermined direction of said printing medium to form different dots having different dot forming conditions with regard to an ejection timing of ink into each pixel, said method comprising the steps of:

inputting print data that represent a density to be expressed in respective of pixels;

outputting a timing signal that specifies a relation between a dot forming condition and a series of driving signals allocated to a respective one of the pixels, a plurality of series of signals being periodically output in a specific cycle; and carrying out the main scan and controlling an on-off condition of each series of driving signals to form a dot in respective of the pixels according to the input print data in response to the timing signal.

13. A computer readable recording medium for a printing apparatus with a print head having at least one dot forming element, the at least one dot forming element being configured to form a dot in response to a driving signal, said printing apparatus being configured to carry out main scan in which said print head moves forward and backward relative to a printing medium in a predetermined direction of said printing medium to form different dots having different dot forming conditions with regard to an ejection timing of ink into each pixel, said computer readable recording medium comprising:

a specific program recorded in a computer readable manner and configured to drive the printing apparatus, said specific program including a program code that causes a computer to specify a relation between a dot forming condition and a series of driving signals allocated to a respective one of the pixels, a plurality of series of driving signals being periodically output in a specific cycle.

* * * * *